US012226019B2

(12) United States Patent
Leng

(10) Patent No.: US 12,226,019 B2
(45) Date of Patent: Feb. 18, 2025

(54) ELASTIC PAD, ELASTIC PAD ASSEMBLING METHOD AND FURNITURE

(71) Applicant: NEW-TEC INTEGRATION (XIAMEN) CO., LTD., Xiamen (CN)

(72) Inventor: Luhao Leng, Xiamen (CN)

(73) Assignee: NEW-TEC INTEGRATION (XIAMEN) CO., LTD, Xiamen (CN)

( * ) Notice: Subject to any disclaimer, the term of this patent is extended or adjusted under 35 U.S.C. 154(b) by 0 days.

(21) Appl. No.: 18/185,917

(22) Filed: Mar. 17, 2023

(65) Prior Publication Data

US 2023/0404280 A1 Dec. 21, 2023

(30) Foreign Application Priority Data

Jun. 17, 2022 (CN) ..... 202210693497.4
Dec. 26, 2022 (CN) ..... 202211678539.3

(51) Int. Cl.
*A47C 23/26* (2006.01)
*A47C 23/00* (2006.01)
*A47C 23/05* (2006.01)

(52) U.S. Cl.
CPC ..... *A47C 23/05* (2013.01); *A47C 23/005* (2013.01)

(58) Field of Classification Search
CPC ... A47C 23/05; A47C 23/005; A47C 23/0435; A47C 23/0433; A47C 23/0431;
(Continued)

(56) References Cited

U.S. PATENT DOCUMENTS 1,127,198 A * 2/1915 Arcy ..... A47C 23/05 5/264.1
1,718,522 A * 6/1929 Brandreth ..... A47C 23/057 5/264.1
(Continued)

FOREIGN PATENT DOCUMENTS

CN 2247466 Y 2/1997
CN 1498568 A 5/2004
(Continued)

OTHER PUBLICATIONS

International Search Report for International Application No. PCT/CN2023/071801; Date of Mailing: May 24, 2023; 5 pages.
(Continued)

*Primary Examiner* — Justin C Mikowski
*Assistant Examiner* — Ifeolu A Adeboyejo
(74) *Attorney, Agent, or Firm* — Perkins Coie LLP

(57) ABSTRACT

The present disclosure relates to the field of elastic pads and discloses an elastic pad, an assembling method thereof and a furniture. An elastic pad includes a first elastic module mounting part, a plurality of first elastic modules disposed on the first elastic module mounting part in a predetermined arrangement, and a pad layer on the plurality of first elastic modules. An outer edge of the pad layer and an outer edge of the first elastic module mounting part are connected via a releasable first connection structure, leaving the sides of the elastic pad open or uncovered. The elastic pad has fewer components, a simple structure, lower cost, and improved comfort. Since the first connection structure is releasable, the pad layer can be disassembled, which facilitates assembling and transportation of the elastic pad and reduces required storage space.

27 Claims, 22 Drawing Sheets

(58) Field of Classification Search
CPC ... A47C 23/0438; A47C 23/26; A47C 23/057; A47C 23/0515
See application file for complete search history.

(56) References Cited

U.S. PATENT DOCUMENTS

| | | | | |
|---|---|---|---|---|
| 4,423,308 | A | 12/1983 | Callaway et al. | |
| 4,868,941 | A | 9/1989 | Tai | |
| 5,752,284 | A * | 5/1998 | Dabney | A47C 23/05 5/247 |
| 5,768,726 | A | 6/1998 | Myles | |
| 5,924,682 | A * | 7/1999 | Bullard | A47C 23/32 267/103 |
| 5,970,547 | A | 10/1999 | Cavazos | |
| 8,370,979 | B2 | 2/2013 | Fukano | |
| 10,869,559 | B2 | 12/2020 | Leng | |
| 11,019,937 | B2 | 6/2021 | Leng | |
| 2013/0075574 | A1* | 3/2013 | Ferraiolo | B28B 7/26 249/1 |
| 2016/0157625 | A1 | 6/2016 | Schneider et al. | |
| 2017/0043338 | A1 | 2/2017 | Tan et al. | |
| 2017/0340129 | A1* | 11/2017 | Leng | A47C 23/005 |
| 2018/0027976 | A1* | 2/2018 | Leng | A47C 19/005 |
| 2018/0199728 | A1* | 7/2018 | Leng | A47C 23/002 |
| 2023/0200553 | A1 | 6/2023 | Leng | |
| 2023/0248156 | A1 | 8/2023 | Leng | |

FOREIGN PATENT DOCUMENTS

| | | | |
|---|---|---|---|
| CN | 104643727 | A | 5/2015 |
| CN | 106820767 | A | 6/2017 |
| CN | 106880220 | A | 6/2017 |
| CN | 207220572 | U | 4/2018 |
| CN | 207285726 | U | 5/2018 |
| CN | 208988046 | U | 6/2019 |
| CN | 209289229 | U | 8/2019 |
| CN | 112237344 | A | 1/2021 |
| CN | 212438015 | U | 2/2021 |
| CN | 212465507 | U | 2/2021 |
| CN | 112674537 | A | 4/2021 |
| CN | 215533110 | U | 1/2022 |
| CN | 216059947 | U | 3/2022 |
| CN | 115191785 | A | 10/2022 |
| CN | 217743729 | U | 11/2022 |
| DE | 20209100 | U1 | 7/2003 |
| DE | 102005026058 | A1 | 4/2006 |
| DE | 202005010441 | U1 | 8/2006 |
| GB | 2607718 | A | 12/2022 |
| JP | 2005046366 | U | 6/1993 |
| JP | 2003204844 | A | 7/2003 |
| JP | 2010252937 | A | 11/2010 |
| JP | 2017196326 | A | 11/2017 |
| KR | 20090003442 | U | 1/2009 |
| WO | 2021073588 | A1 | 4/2021 |
| WO | 2021073598 | A1 | 4/2021 |

OTHER PUBLICATIONS

Office Action in German Application No. 102023108621.9; Date of Mailing: Jun. 27, 2023; 22 pages.
Office Action in United Kingdom Application No. GB2303457.2; Date of Mailing: May 2, 2023; 6 pages.
Extended European Search Report for European Application No. 23162029.5; Date of Mailing: Nov. 13, 2023; 9 pages.
Notification of Reasons for Refusal for Japanese Application No. 2023-063489; Date of Mailing: Apr. 26, 2024; 7 pages.
Notification of Reasons for Refusal for Japanese Application No. 2023-063489. Mail Date: Oct. 24, 2024. 16 pages with English translation.

* cited by examiner

ELASTIC PAD, ELASTIC PAD ASSEMBLING METHOD AND FURNITURE

FIELD

The present disclosure relates to the field of elastic pads, in particular an elastic pad, an elastic pad assembling method and a furniture comprising the elastic pad.

BACKGROUND

Furniture such as beddings and sofa beds are essentials in daily life. Most existing beddings and sofa beds are provided with elastic pads. Elastic pads are resilient, which can provide an elastic support when a person is lying on the bedding and the sofa bed. Thus, an elastic pad is more comfortable than a hard pad.

Existing elastic pads are typically a one-piece, non-detachable, enclosed pad consisting of an integral bottom layer, a spring layer, a sponge overlay and an enclosing side surrounding cover. That is the spring layer is disposed on the bottom layer, the sponge overlay is disposed on the spring layer, and the enclosing side surrounding cover is connected between the sponge overlay and the bottom layer, to form a closed space. However, in actual use, these types of elastic pads are costly, inconvenient to transport, and take up a large space when stored.

SUMMARY

In view of at least some problems existing in the prior art, objectives of the invention include lowering the cost of elastic mattresses, making transportation of the elastic mattresses easier, and reducing the storage space required for elastic mattresses, while also providing elastic mattresses having a high degree of comfort.

In a first aspect, the present disclosure provides an elastic pad, comprising: a first elastic module mounting part, a plurality of elastic modules, and a pad layer, wherein the plurality of first elastic modules are disposed on the first elastic module mounting part in a predetermined arrangement pattern in a height direction of the elastic pad, the pad layer is laid on the plurality of first elastic modules in the height direction of the elastic pad An outer edge of the pad layer and an outer edge of the first elastic module mounting part are connected via a first releasable connection structure which provides an elastic pad formed as an elastic pad without an enclosing side surrounding cover.

In the technical solution, as the outer edge of the pad layer is connected with the outer edge of the first elastic module mounting part via the first connection structure, the elastic pad forms an elastic pad without an enclosing side surrounding cover, to avoid having an enclosing side surrounding cover in the surrounding area between the pad layer and the first elastic module mounting part. The number of components of the elastic pad is reduced, the structure is simplified, and cost is reduced. Since the first connection structure is releasable, the pad layer can be disassembled, which facilitates assembling and transportation of the elastic pad and reduces required storage space. In addition, the elastic pad provides a high degree of comfort.

In some embodiments, the pad layer comprises a first stop ring extending from a pad layer lower surface of the pad layer towards the plurality of the first elastic modules, the first stop ring being configured to enclose a first elastic module located at an outermost side of the elastic pad, wherein the first stop ring is connected to the outer edge of the first elastic module mounting part via the first connection structure.

In some embodiments, the first stop ring is at a predetermined distance from an outer periphery of the pad layer.

In some embodiments, the pad layer is a foldable or rollable material layer.

In some embodiments, the pad layer comprises a plurality of elastic pad blocks arranged in a length direction of the elastic pad, and the elastic pad blocks adjacent to each other are connected via a thinned flexible hinge part.

In some embodiments, the flexible hinge part comprises a groove formed on a pad layer upper surface and/or a pad layer lower surface of the pad layer and extending along a width direction of the elastic pad.

In some embodiments, the first connection structure comprises a connection rope and a fixture buckle that are releasably connected to each other.

In some embodiments, a plurality of the connection ropes are arranged at intervals on one of the outer edge of the pad layer and the outer edge of the elastic module mounting part, and a plurality of the fixture buckles are arranged at intervals on the other one of the outer edge of the pad layer and the outer edge of the elastic module mounting part, wherein each of the connection ropes can be hung onto a corresponding one of the fixture buckles.

In some optional embodiments, a plurality of the fixture buckles are disposed at predetermined intervals on the outer edge of the pad layer, a plurality of the fixture buckles are disposed at predetermined intervals on the outer edge of the first elastic module mounting part, and the connection ropes connect the plurality of the fixture buckles of the pad layer and the plurality of the fixture buckles of the first elastic module mounting part in a wavy extension path.

In some embodiments, the plurality of the fixture buckles of the pad layer and the plurality of the fixture buckles of the first elastic module mounting part are arranged alternately and sequentially at internals, wherein the plurality of the fixture buckles of the pad layer are hanging holes, and the plurality of the fixture buckles of the first elastic module mounting part are hooks.

In some embodiments, the first elastic module mounting part comprises a plurality of first positioning rails arranged at intervals in a length direction of the elastic pad. Each of the first positioning rails extends along a width direction of the elastic pad, and first elastic module mounting areas are respectively formed between the first positioning rails adjacent to each other, wherein in the width direction of the elastic pad, each of the first elastic modules is configured to form a sliding fit with the adjacent first positioning rails at either end of the adjacent first positioning rails to slide into the first elastic module mounting area, and further slide along the first positioning rail to a set position, so that each of the first elastic module mounting areas is provided with a plurality of the first elastic modules therein. The outer edge of the pad layer may be connected with two ends of each of the first positioning rails via the first connection structure.

In some embodiments, the first elastic module mounting part comprises a first base layer having a first base layer upper surface and a first base layer lower surface opposing to each other in the height direction of the elastic pad; the plurality of the first elastic modules are disposed on the first base layer upper surface; and the outer edge of the pad layer is connected to the outer edge of the first base layer via the first connection structure.

In some embodiments, an outer edge of the first base layer upper surface is disposed with first stop edges extending a predetermined height in the height direction of the elastic pad, the plurality of the first elastic modules are located between the first stop edges, and the outer edge of the pad layer is connected with the first stop edges via the first connection structure.

In some embodiments, the first base layer upper surface is disposed with a plurality of first positioning rails arranged at intervals in a length direction of the elastic pad, each of the first positioning rails extending along a width direction of the elastic pad, and first elastic module mounting areas respectively formed between the adjacent first positioning rails. In the width direction of the elastic pad, each of the first elastic modules is configured to form a sliding fit with the adjacent first positioning rails at either end of the adjacent first positioning rails to slide into the first elastic module mounting area, and further slide along the first positioning rail to a set position, so that each of the first elastic module mounting areas is provided with a plurality of the first elastic modules therein. The plurality of the first positioning rails are located between the first stop edges, and the first stop edges are configured to stop movement of the first elastic modules in the width direction of the elastic pad.

In some embodiments, the elastic pad further comprises a balance pad, wherein the balance pad is laid on the plurality of the first elastic modules in the height direction of the elastic pad to limit transverse movement of the plurality of the first elastic modules, and the pad layer is laid on the balance pad in the height direction of the elastic pad.

In some embodiments, the pad layer and the balance pad are connected via a positioning structure arranged therebetween.

In some embodiments, the positioning structure comprises Velcro tapes disposed on a pad layer lower surface of the pad layer and/or a balance pad upper surface of the balance pad.

In some embodiments, the elastic pad further comprises: a second elastic module mounting part; and a plurality of second elastic modules disposed on the second elastic module mounting part in a predetermined arrangement pattern in the height direction of the elastic pad; wherein the first elastic module mounting part is laid on the plurality of the second elastic modules in the height direction of the elastic pad, and an outer edge of the second elastic module mounting part is connected to the outer edge of the first elastic module mounting part via a releasable second connection structure which makes the elastic pad be formed as an elastic pad without an enclosing side surrounding cover.

In some embodiments, the second connection structure and the first connection structure are the same.

In some embodiments, a height of the first elastic module is greater than a height of the second elastic module, wherein the elastic pad comprises a balance pad laid on the plurality of the first elastic modules in the height direction of the elastic pad to limit transverse movement of the plurality of the first elastic modules, and the pad layer is laid on the balance pad in the height direction of the elastic pad.

In some embodiments, the pad layer and the balance pad are connected via a positioning structure arranged therebetween.

In some embodiments, the positioning structure comprises Velcro tapes disposed on a pad layer lower surface of the pad layer and/or a balance pad upper surface of the balance pad.

In some embodiments, the elastic pad further comprises a support layer laid on the plurality of the second elastic modules, and an outer edge of the second elastic module mounting part is connected to an outer edge of the support layer via the second connection structure; wherein the first elastic module mounting part is connected to an upper surface of the support layer.

In some embodiments, the outer edge of the support layer comprises a second stop ring extending out towards the second elastic module mounting part when being in a mounted state, and the second stop ring is configured to enclose the second elastic modules located at an outermost side of the elastic pad, wherein the outer edge of the second elastic module mounting part is connected with the second stop ring via the second connection structure.

In some embodiments, the second elastic module mounting part comprises a second base layer, the second base layer comprising a second base layer upper surface and a second base layer lower surface opposing to each other in the height direction of the elastic pad, wherein the plurality of the second elastic modules are disposed on the second base layer upper surface, and an outer edge of the second base layer is connected with the second connection structure.

In some embodiments, an outer edge of the second base layer upper surface is disposed with second stop edges extending a predetermined height in the height direction of the elastic pad, the plurality of the second elastic modules are located between the second stop edges, and the second stop edges are connected with the second connection structure.

In some embodiments, the second base layer upper surface is disposed with a plurality of second positioning rails arranged at intervals in a length direction of the elastic pad, each of the second positioning rails extending in a width direction of the elastic pad, and second elastic module mounting areas formed between the adjacent second positioning rails In the width direction of the elastic pad, each of the second elastic modules is configured to form a sliding fit with the adjacent second positioning rails at either end of the adjacent second positioning rails to slide into the second elastic module mounting area, and further slide along the second positioning rail to a set position, so that each of the second elastic module mounting areas is provided with a plurality of the second elastic modules therein. The plurality of the second positioning rails are located between the second stop edges, and the second stop edges are configured to stop movement of the second elastic modules in the width direction of the elastic pad.

In some embodiments, the plurality of the first elastic modules are divided into a first module group and a second module group arranged in a length direction of the elastic pad, wherein a height of a plurality of first elastic modules in the first module group is greater than a height of a plurality of first elastic modules in the second module group, and the pad layer is laid on the first module group and the second module group so that a first pad layer area corresponding to the first module group and a second pad layer area corresponding to the second module group are formed on the pad layer due to a height difference between the first module group and the second module group. The first pad layer area is higher than the second pad layer area, and an area of the first pad layer area is smaller than an area of the second pad layer area.

In some embodiments, the first pad layer area is connected with the second pad layer area via a flexible hinge part.

In some embodiments, the elastic pad comprises a balance pad laid on the plurality of the first elastic modules of the first module group in the height direction of the elastic pad to limit transverse movement of the first modules group, and the first pad layer area is laid on the balance pad in the height direction of the elastic pad.

In some embodiments, the pad layer comprises heating elements configured for heating areas of the pad layer required for heating.

In some embodiments, at least a part of a plurality of regions of the pad layer are provided with the heating elements, respectively, and the heating elements can be controlled so that the individually areas required to be heated can be heated by a corresponding heating elements.

In some embodiments, the elastic pad is used as an elastic mattress.

In the second aspect, the present disclosure provides an elastic pad assembling method, comprising: providing an elastic support layer comprising at least one layer of elastic module mounting part and a plurality of elastic modules disposed on the at least one layer of elastic module mounting part in a predetermined arrangement pattern in a height direction of an elastic pad; laying a pad layer on the plurality of the elastic modules of a topmost layer in the height direction of the elastic pad; and connecting an outer edge of the pad layer to an outer edge of the elastic module mounting part via a releasable connection structure so as to form an elastic pad without an enclosing side surrounding cover.

In the elastic pad assembling method, as the outer edge of the pad layer is connected to the outer edge of the elastic module mounting part via the releasable connection structure, so that the elastic pad forms an elastic pad without an enclosing side surrounding cover, to thus avoid arranging an enclosing side surrounding cover in the surrounding area between the pad layer and the first elastic module mounting part (i.e. to avoid the arrangement of the an enclosing side surrounding cover). Therefore, the present disclosure can improve the air permeability between the inside and outside of the elastic pad, effectively reduce the number of components of the elastic pad, simplify the structure, and lower the cost. Since the first connection structure is releasable, the pad layer can be disassembled, which facilitates assembling and transportation of the elastic pad and reduces the storage space thereof. In addition, the elastic pad exhibits excellent performance in comfort.

In some embodiments, the elastic support layer comprises a plurality of layers of elastic module mounting parts, each layer of the elastic module mounting part is provided with a plurality of corresponding elastic modules, and an outer edge of a topmost layer of elastic module mounting part is connected with an outer edge of a lowermost layer of elastic module mounting part via a releasable connection structure so as to form an elastic pad without an enclosing side surrounding cover.

In some embodiments, the elastic pad assembling method further comprises: connecting the outer edge of the pad layer with the outer edge of the topmost layer of elastic module mounting part via a releasable connection structure.

In some embodiments, the releasable connection structure comprises connection ropes and fixture buckles that are releasably connected to each other, and the elastic pad assembling method further comprises hanging the respective connection ropes onto the respective corresponding fixture buckles.

In some embodiments, laying, in the height direction of the elastic pad, a balance pad on a predetermined layer of a plurality of elastic modules where the elastic modules reach a predetermined height, to limit transverse movement of the plurality of the elastic modules of the predetermined layer.

In some embodiments, a height of the plurality of elastic modules of the topmost layer is greater than a height of a plurality of elastic modules of other layers, wherein the elastic pad assembling method further comprises: laying, in the height direction of the elastic pad, the balance pad on the topmost layer of the plurality of the elastic modules to limit transverse movement of the plurality of elastic modules of the topmost layer; and laying the pad layer on the balance pad in the height direction of the elastic pad.

In the third aspect, the present disclosure provides an elastic pad which is assembled through the elastic pad assembling method according to any one of the second aspect as described above.

In some embodiments, the elastic pad is used as an elastic mattress.

In the fourth aspect, the present disclosure provides a furniture comprising the elastic pad according to any one of the first and third aspects as described above. Therefore, as aforementioned, with the elastic pad, the furniture exhibits excellent performance in stability and comfort while the furniture cost can be reduced, thus improving the overall quality.

In addition, the furniture includes, but is not limited to, beds, sofas, chairs, sofa beds, upholstered benches, and the like.

Elements or features described above in a single embodiment may be used, alone or in combination, in other embodiments.

BRIEF DESCRIPTION OF THE DRAWINGS

Dimensions and proportions in the drawings do not represent the dimensions and proportions of actual products. The drawings are only provided illustratively, and some unnecessary elements or features are omitted therefrom for clarity.

REFERENCE SIGNS

1—elastic pad, 2—first elastic module mounting part, 3—first elastic module, 4—pad layer, 5—first connection structure, 6—pad layer lower surface, 7—first stop ring, 8—elastic pad block, 9—pad layer upper surface, 10—groove, 11—connection cord or rope, 12—fixture buckle, 13—first positioning rail, 14—first elastic module mounting area, 15—first base layer, 16—first base layer upper surface, 17—first base layer lower surface, 18—first stop edge, 19—balance pad, 20—balance pad upper surface, 21—Velcro tape, 22—second elastic module mounting part, 23—second elastic module, 24—second connection structure, 25—second stop ring, 26—second base layer, 27—second base layer upper surface, 28—second stop edge, 29—second positioning rail, 30—second elastic module mounting area, 31—first module group, 32—second module group, 33—first pad layer area, 34—second pad layer area, 35—flexible hinge part, 36—heating element, 37—support layer, and 38—power interface.

DETAILED DESCRIPTION OF EMBODIMENTS

Reference now will be made to the drawings to describe in detail the elastic pad and furniture according to the present disclosure. What will be described herein will only cover preferred embodiments of the present disclosure, and those skilled in the art would envision, on the basis of the preferred embodiments, other possible manners which also fall into the scope described herein.

Figure 1:
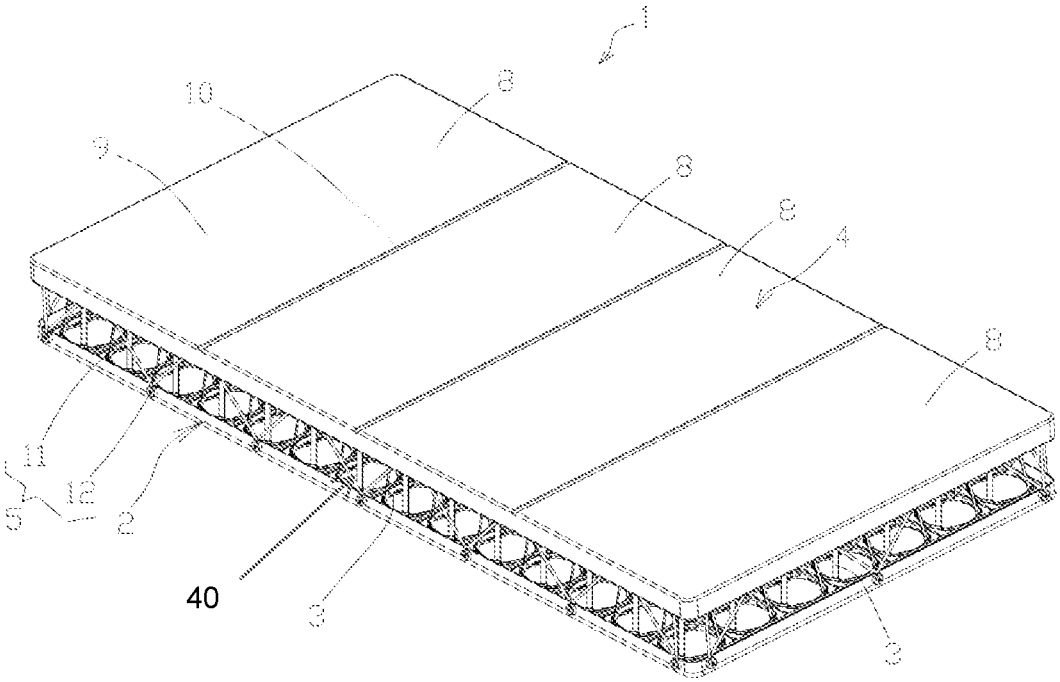
FIG. 1 is a three-dimensional view exemplarily illustrating a first type of elastic pad.
Figure 2:
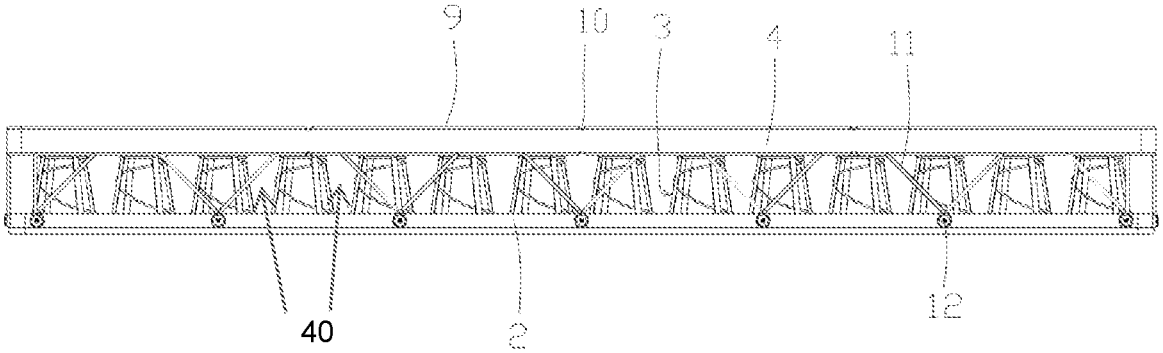
FIG. 2 is a schematic view of a front structure of the elastic pad in FIG. 1.
Figure 3:
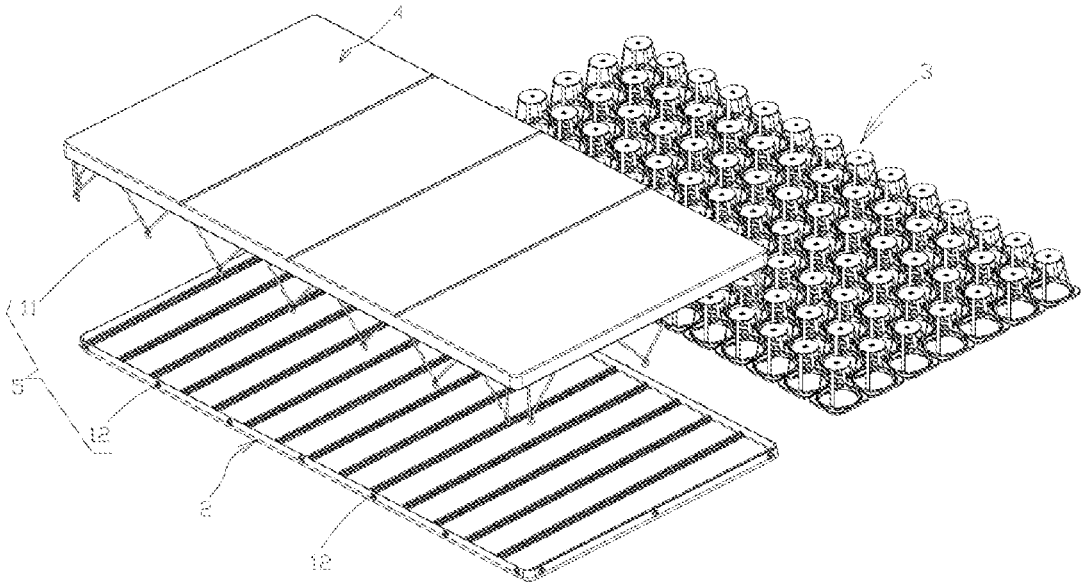
FIG. 3 is an exploded view of the elastic pad in FIG. 1.

In a first aspect, referring to the elastic pad according to different embodiments as shown in FIGS. 1, 6, 10, 17, 23 and 31, the elastic pad 1 according to the present disclosure includes a first elastic module mounting part 2, a plurality of first elastic modules 3, and a pad layer 4, wherein the plurality of elastic modules 3 are distributed on the first elastic module mounting part in a predetermined manner in the height direction of the elastic pad, to form a predetermined arrangement pattern, and the pad layer 4 is laid on the plurality of first elastic modules 3, and wherein an outer edge of the pad layer 4 and an outer edge of the first elastic module mounting part 2 are connected via a releasable first connection structure 5, with the elastic pad 1 having no enclosing side surrounding cover. That is, as shown in FIGS. 1 and 2, the pad layer 4 is spaced apart from the elastic module mounting part 2 by the elastic modules 3. This provides empty spaces or open-ended channels 40 between them extending in between and through the rows and columns of elastic modules 3. Since there is no enclosing side cover, i.e., no material covering the sides of the elastic pad 1, the sides are open and air can flow the channels 40. Correspondingly, the elastic modules 3 at the perimeter of the elastic pad 1 are visible. Of course, the sides may optionally be covered by a net or mesh material to achieve the same result.

Since the outer edge of the pad layer 4 and the outer edge of the first elastic module mounting part 2 are connected via the first connection structure 5, the elastic pad 1 forms an elastic pad without an enclosing side surrounding cover, to thus avoid arranging an enclosing side surrounding cover in the surrounding area between the pad layer 4 and the first elastic module mounting part 2. Therefore, the present disclosure can effectively reduce the number of components of the elastic pad, simplify the structure of the elastic pad, and lower the cost of the elastic pad. Since the first connection structure 5 is releasable, the pad layer 4 can be disassembled, which facilitates assembling and transportation of the elastic pad and reduces the storage space thereof. In addition, the elastic pad exhibits excellent performance in comfort.

Figure 4:
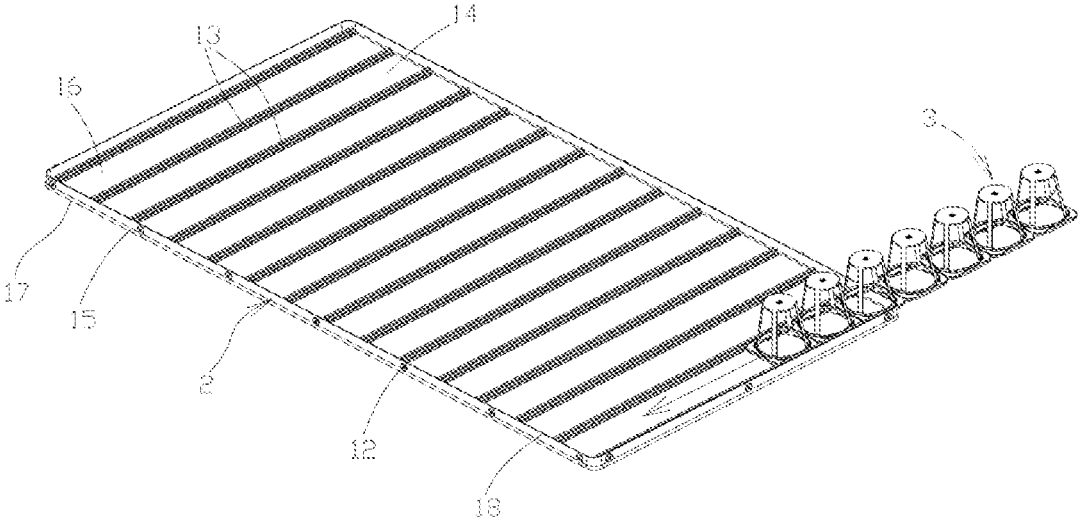
FIG. 4 is a schematic view of a structure wherein first elastic modules are mounted on a first elastic module mounting part of the elastic pad in FIG. 1.
Figure 5:
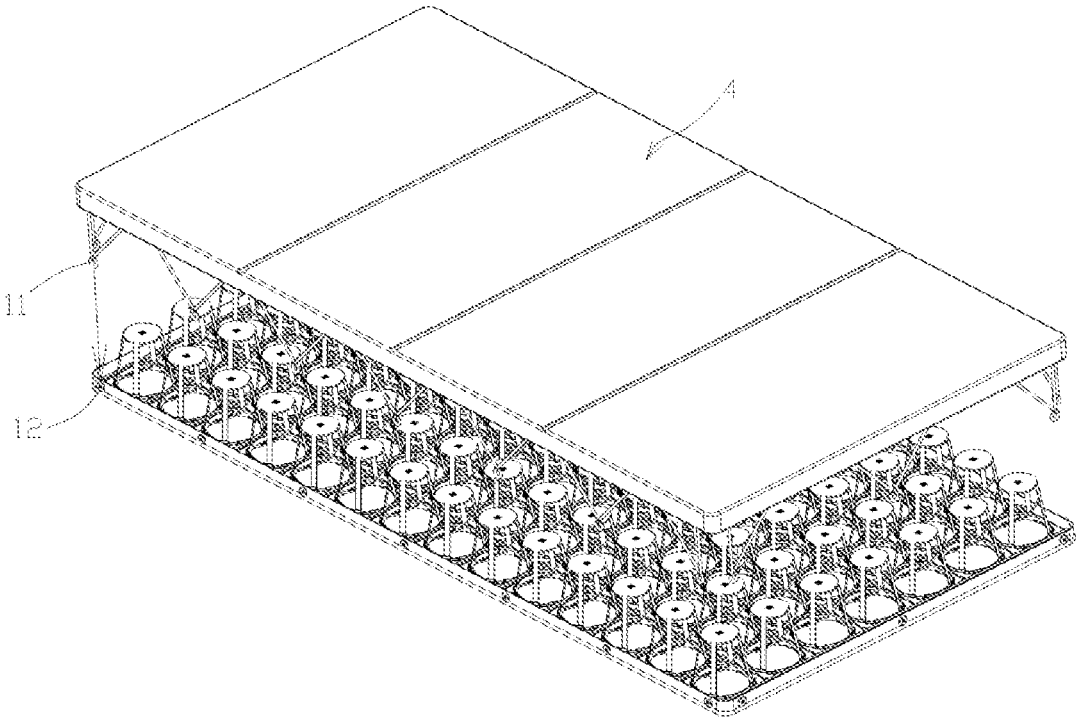
FIG. 5 is a schematic view of a structure wherein a pad layer covers the first elastic modules and is connected with the first elastic module mounting part via a first connection structure of the elastic pad in FIG. 1.
Figure 6:
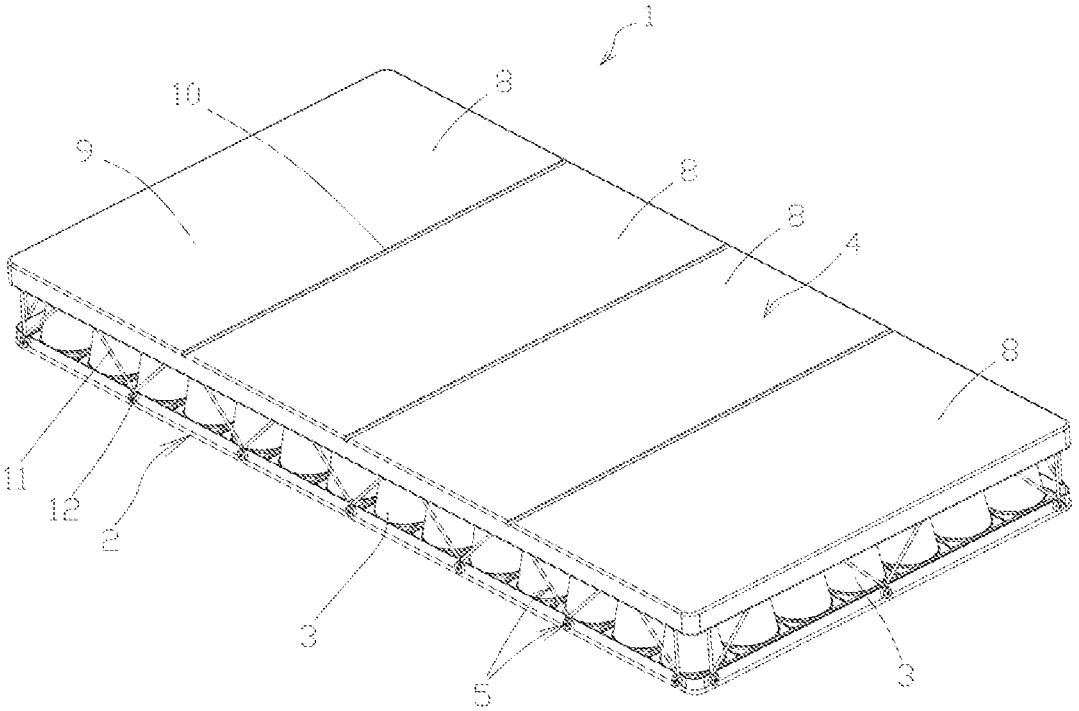
FIG. 6 is a three-dimensional view exemplarily illustrating a second type of elastic pad.

FIG. 1 shows a first type of elastic pad 1 according to the present disclosure. Referring to FIG. 2, there is no first stop ring 7 extending downwards out from the pad layer lower surface 6 of the pad layer 4, and in the case, the first connection structure 5 connects the outer edge of the pad layer 4 and the outer edge of the first elastic module mounting part 2. Referring to FIGS. 4-5, when the first type of elastic pad 1 is assembled, a plurality of elastic modules 3 are disposed on the first elastic module mounting part 2 to form a predetermined arrangement pattern, the pad layer 4 covers all of the first elastic modules 3, and the pad layer 4 and the first elastic module mounting part 2 are then connected via the first connection structure 5, to thus form the first type of the elastic pad 1. As such, the elastic pad 1 can be simply assembled and disassembled. Since there are no enclosing side surrounding covers, the elastic pad 1 has a permeable inner structure and an excellent ventilation performance, which is suitable for outdoor use.

In the elastic pad 1, the first elastic module 3 may be of multiple types. For example, in the first type of the first elastic module 3, as shown in FIGS. 1 and 5, the first elastic module 3 includes a spring, an upper cover, and a bottom ring, wherein the upper cover and the bottom ring are connected via a plurality of connection bars arranged at intervals in the circumferential direction, and the spring is clamped and positioned among the upper cover, the bottom ring and the connection bar. Another type of the first elastic module 3 is depicted in the second type of elastic pad 1 as shown in FIGS. 6-9. Except for the different first elastic module 3, other structures of the second type of elastic pad 1 are identical to those of the first type of elastic pad 1. In the second type of elastic pad 1, the first elastic module 3 is a pocket spring. Others type of the first elastic module 3 may be a silicone column. Referring to FIGS. 6-9, the assembling of the second type of elastic pad 1 is identical to the assembling of the first type of elastic pad 1, and the details thereof are omitted here for brevity.

Figure 14:
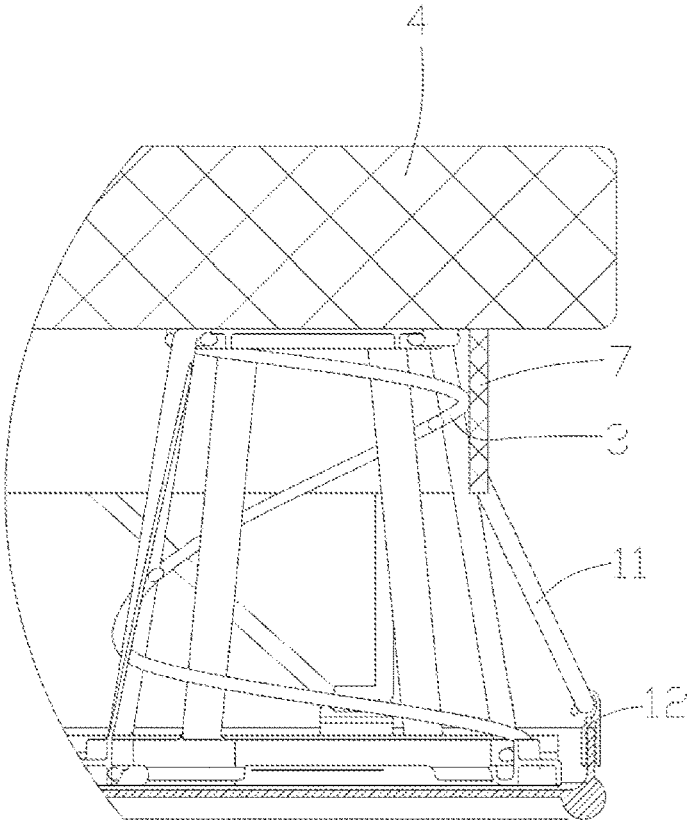
FIG. 14 is a schematic, partially enlarged view of a position of the elastic pad in FIG. 10.

FIGS. 10-14 show a third type of elastic pad 1. In the third type of elastic pad 1, the pad layer 4 includes a first stop ring 7 extending out from the pad layer lower surface 6 of the pad layer 4 towards the plurality of first elastic modules 3, i.e., a first stop ring 7 extending out downwards from the pad layer lower surface 6. Referring to FIG. 14, the first stop ring 7 is configured to enclose the first elastic module 3 located at the outermost side of the elastic pad, and at this time, the first stop ring 7 is connected to the outer edge of the first elastic module mounting part 2 via the first connection structure 5. In the circumstance, referring to FIG. 14, after the first connection structure 5 (e.g. a connection rope 11 and a fixture buckle 12 as will be described below) at its surroundings connects the first stop ring 7 and the first elastic module mounting part 2, the first connection structure 5 may tighten the first stop ring 7 to place the first stop ring 7 in a tensioned state. Therefore, the first elastic modules 3 can be stopped to improve the stability between the first elastic modules 3 and the pad layer 4 and enhance the comfort.

Moreover, the first stop ring 7 may be welded, sewn or zipped to the pad layer lower surface 6.

In the third type of elastic pad 1, the first stop ring 7 may be connected at the outer peripheral surface of the pad layer 4. Alternatively, referring to FIG. 14, the first stop ring 7 is at a predetermined distance from the outer periphery of the pad layer 4. In this way, the first connection structure 5 tightens the first stop ring 7 so that the first stop ring 7, when being in the tensioned state, can stop movement of the first elastic module 3 more effectively.

In addition, irrespective of the structure of the elastic pad 1 according to the present disclosure, the pad layer 4 may be of multiple types. For example, the pad layer 4 may be a hard pad layer. For convenience in storage, the hard pad layer may include a plurality of pad layer blocks which can be spliced with one another via buckles, Velcro tapes or other connection structures. Alternatively, the pad layer may be a foldable or rollable material layer. For example, the pad layer 4 may be a soft pad layer so that it can be folded or rolled. Alternatively, the pad layer is a foldable or rollable elastic pad layer. For example, the pad layer 4 may be a sponge pad layer or silicone pad layer. Such elastic pad layer cannot only cooperate with a plurality of elastic modules to improve the elasticity and comfort of the elastic pad, but also can be further compressed when folded or rolled to reduce the occupied space.

For convenience in storing the pad layer 4, in some embodiments, the pad layer 4 includes a plurality of elastic pad blocks 8 arranged in the length direction of the elastic pad, and adjacent elastic pad blocks 8 are connected via a flexible hinge part (for example a thinned flexible hinge part) to allow stacking or rolling-up of the adjacent elastic pad blocks. As such, when stored, the plurality of elastic pad blocks 8 are folded or rolled. In use, since the plurality of elastic pad blocks 8 are connected via the thinned flexible hinge part, only the plurality of elastic pad blocks 8 are unfolded, without the need for assembling each elastic pad. For example, in some embodiments, the plurality of elastic pad blocks 8 may be sponge pad blocks or silicone pad blocks.

The flexible hinge part may be of multiple types. For example, as one type, the flexible hinge part may be a connecting cloth. For instance, a cloth cover includes spaced receiving spaces, the connecting cloth (the partition part) between the receiving spaces is used as the flexible hinge part, and the respective elastic pad blocks 8 may be encapsulated in the respective receiving spaces. Alternatively, as a further type, the flexible hinge part is formed by a part of the pad layer 4. Referring to FIGS. 1 and 2, the flexible hinge part includes a groove 10 formed on the pad layer upper surface 9 and/or the pad layer lower surface of the pad layer 4 and extending along the width direction of the elastic pad. FIGS. 1 and 2 show the grooves 10 are formed on the pad layer upper surface 9 of the pad layer 4. That is, the grooves 10 divide the pad layer 4 into a plurality of elastic pad blocks 8, and by means of the grooves 10, the plurality of elastic pad blocks 8 can be conveniently folded or rolled for storage.

In the elastic pad 1 according to the present disclosure, the first connection structure may be of multiple types. For example, as a type, the first connection structure may include a first Velcro tape and a second Velcro tape, wherein one of the first Velcro tape and the second Velcro tape is disposed on the pad layer 4, and the other one is disposed on the first elastic module mounting part 2. Accordingly, by means of a plurality of the first Velcro tapes and the second Velcro tapes disposed in the surrounding, the pad layer 4 can be connected with the first elastic module mounting part 2. In the case, there is no need for arranging an enclosing side surrounding cover in the surrounding area between the pad layer 4 and the first elastic module mounting part 2. For another example, as a type of the first connection structure, referring to FIGS. 1 and 5, the first connection structure includes a connection rope and a fixture buckle 12 that can be releasably connected to each other. As such, the connection rope 11 and the fixture buckle 12 are connected in the surrounding of the elastic pad, i.e., the pad layer 4 and the first elastic module mounting part 2 can be connected, to thus avoid arranging an enclosing side surrounding cover in the surrounding area between the pad layer 4 and the first elastic module mounting part 2.

Figure 15:
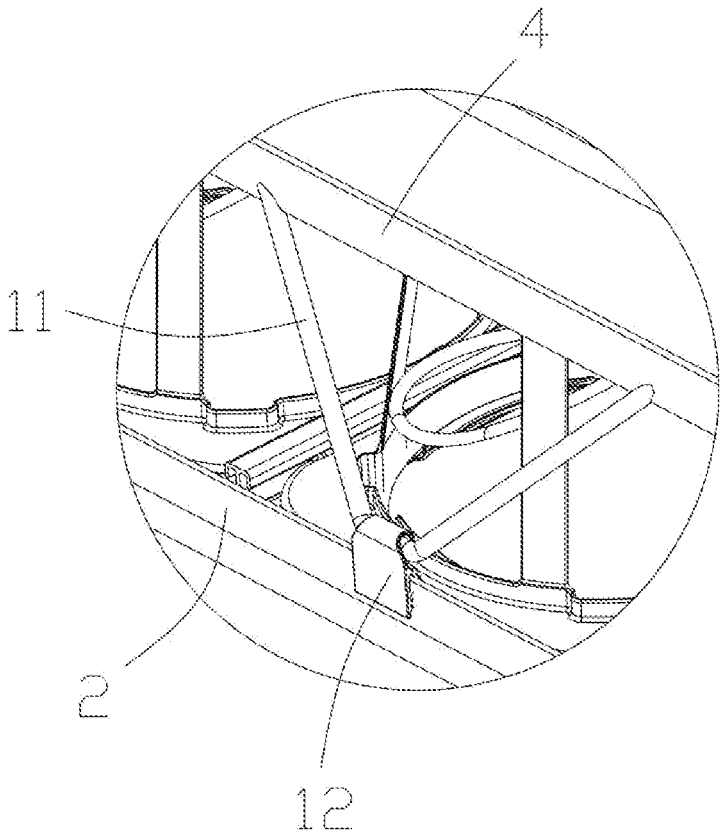
FIG. 15 is a schematic, partially enlarged view of another position of the elastic pad in FIG. 10, which shows a type of the first connection structure.
Figure 16:
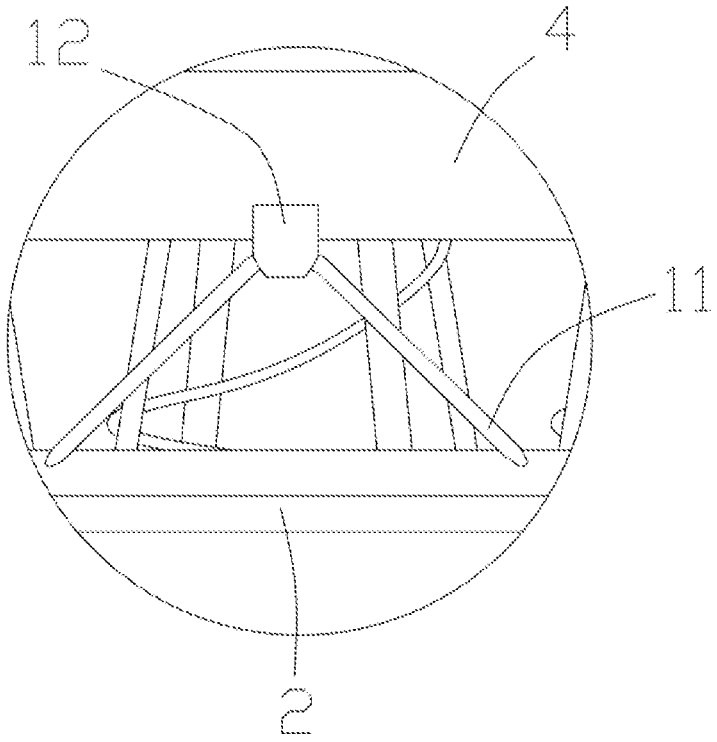
FIG. 16 is a schematic view of another type of the first connection structure.
Figure 17:
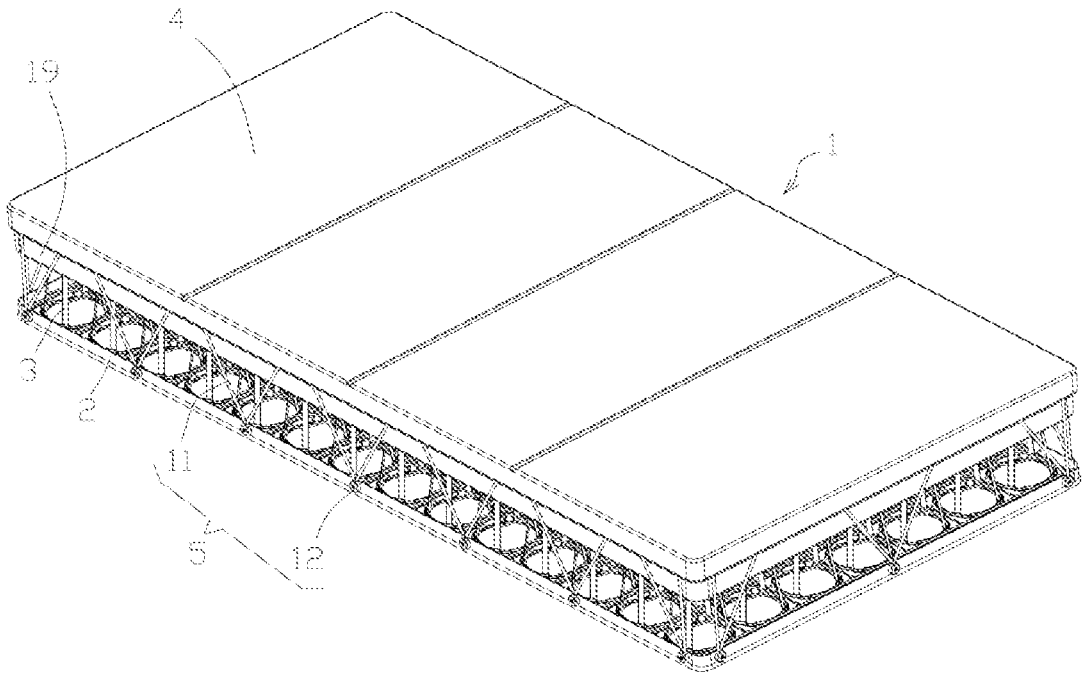
FIG. 17 is a three-dimensional view exemplarily illustrating a fourth type of elastic pad.
Figure 18:
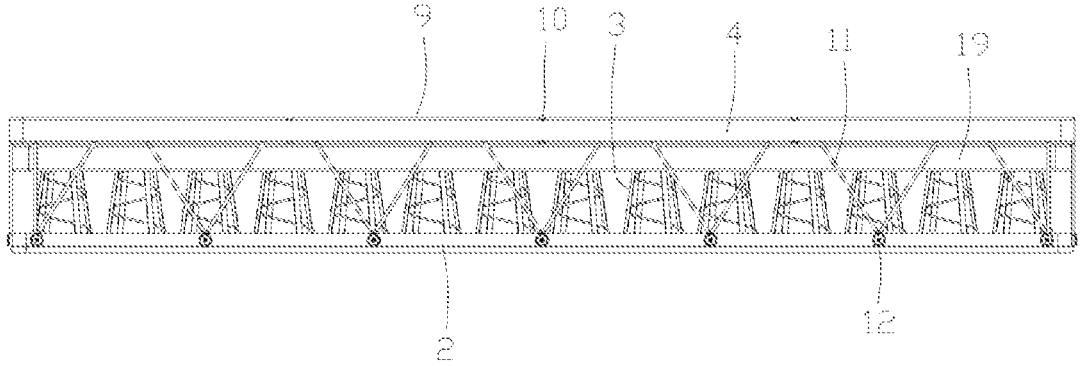
FIG. 18 is a schematic view of a front structure of the elastic pad in FIG. 17.
Figure 19:
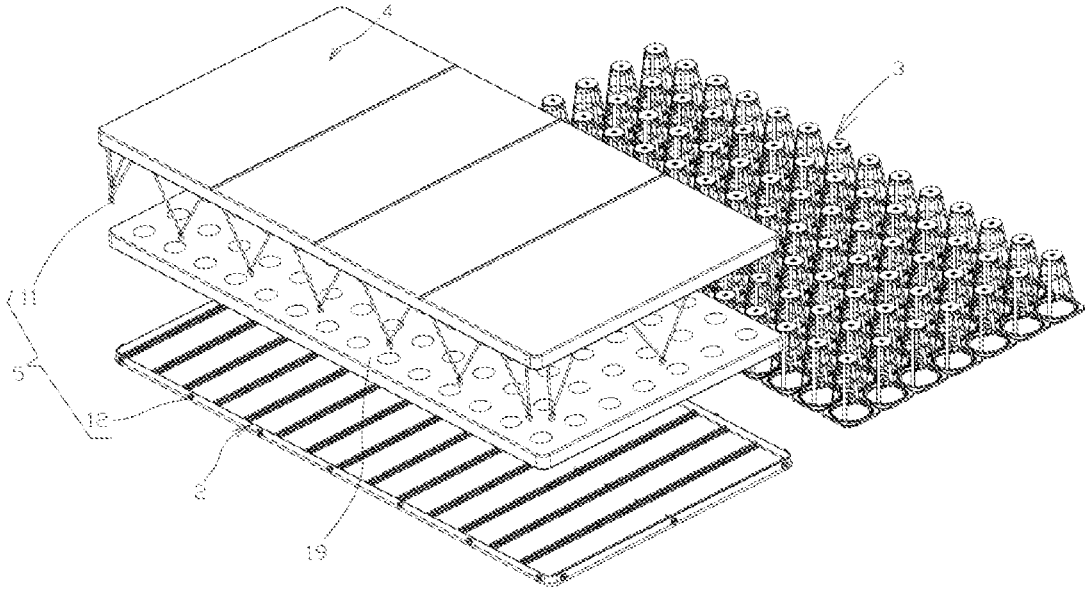
FIG. 19 is an exploded view of the elastic pad in FIG. 17.

In the type of the first connection structure including a connection rope 11 and a fixture buckle 12, the connecting rope 11 and the fixture buckle 12 may be arranged in multiple forms. For example, in one arrangement, referring to FIGS. 15 and 16, a plurality of connection ropes 11 are circumferentially spaced apart from one another on one of the outer edge of the pad layer 4 and the outer edge of the first elastic module mounting part 2, and a plurality of fixture buckles 12 are circumferentially spaced apart from one another on the other one of the outer edge of the pad layer 4 and the outer edge of the first elastic module mounting part 2. For instance, in FIG. 15, the connection rope 11 is connected to the pad layer 4, and the fixture buckle 12 is connected to the first elastic module mounting part 2; in FIG. 16, the connection rope 11 is connected to the first elastic module mounting part 2, and the fixture buckle 12 is connected to the pad layer 4, wherein each connection rope 11 can be hung onto a corresponding fixture buckle 12. In the circumstance, after the pad layer 4 is laid on the plurality of first elastic modules 3, each connection rope 11 is tightened and secured to the corresponding fixture buckle 12 in the surrounding of the elastic pad. For another example, in another arrangement, a plurality of fixture buckles 12 are disposed at predetermined intervals in the circumferential direction on the outer edge of the pad layer 4, a plurality of fixture buckles 12 are disposed at a predetermined intervals in the circumferential direction on the outer edge of the first elastic module mounting part 2, and the connection rope 11 is connected, in a wavy extension path, to the plurality of fixture buckles 12 of the pad layer 4 and the plurality of fixture buckles 12 of the first elastic module mounting part 2. That is, after connected with a fixture buckle 12 of the pad layer 4, the connection rope 11 extends downwards and is connected with a fixture buckle 12 of the first elastic module mounting part 2, thereafter extends upwards and is connected with another adjacent fixture buckle 12 of the pad layer 4, subsequently extends downwards and is connected with a further adjacent fixture buckle 12 of the first elastic module mounting part 2, and so on, until the connection rope 11 connects all the fixture buckles 12. In this way, the connection rope 11 forms a wavy extension path.

In some embodiments, the plurality of fixture buckles 12 of the pad layer 4 and the plurality of fixture buckles 12 of the first elastic module mounting part 2 may be aligned in the height direction of the elastic pad. Therefore, two connection ropes 11 are required, and the two connection ropes 11 can form two wavy extension paths after each connection rope 11 is connected in the above manner. Alternatively, in some embodiments, the plurality of fixture buckles 12 of the pad layer 4 and the plurality of fixture buckles 12 of the first elastic module mounting part 2 are arranged alternately and sequentially at intervals. Accordingly, after one connection rope 11 is connected in the above manner, one wavy extension path can be formed.

The fixture buckle 12 may be of multiple types. For example, the fixture buckle 12 may be a hanging hole, a hook or an end of the first positioning rail 13 or second positioning rail 29 as will be described below. For instance, in some embodiments, the plurality of fixture buckles 12 of the pad layer 4 are hanging holes, and the plurality of fixture buckles 12 of the first elastic module mounting part 2 are hooks. In the circumstance, the connection rope 11 passes through the hanging holes and mate with the hooks. The hooks can enhance the connection stability of the connection rope 11, and the hooks can improve convenience in removing the connection rope 11. Therefore, with the hanging holes and hooks, the present disclosure can enhance the stability while improving the convenience in removing the connection rope 11.

In some embodiments, the plurality of fixture buckles 12 of the pad layer 4 are hanging holes, and the plurality of fixture buckles 12 of the first elastic module mounting part 2 are hanging holes. In the case, the connection rope 11 can sequentially pass through the hanging holes of the pad layer 4 and the hanging holes of the first elastic module mounting part 2.

In various elastic pads according to the present disclosure, the first elastic module mounting part 2 may be of multiple types. For example, as a first type of the first elastic module mounting part 2, referring to FIG. 7, the first elastic module mounting part 2 includes a plurality of first positioning rails 13 arranged at intervals in the length direction of the elastic pad, each positioning rail 13 extends along the width direction of the elastic pad, and a first elastic module mounting area 14 is formed between adjacent first positioning rails 13. Wherein, in the width direction of the elastic pad, each first elastic module 3 can form a sliding fit with the adjacent first positioning rails 13 at either end of the adjacent first positioning rails 13 to slide in the first elastic module mounting area 14, and slide to a set position along the first positioning rail 13, so that each first elastic module mounting area 14 is provided with a plurality of first elastic modules 3 therein. Wherein, the outer edge of the pad layer 4 is connected with two ends of each first positioning rail 13 via the first connection structure. In other words, the plurality of first positioning rails 13 are arranged at intervals in the length direction of the elastic pad, and the first elastic module 3 is mounted between adjacent first positioning rails 13. For example, the above-mentioned fixture buckles 12 may be disposed at two ends of the first positioning rail 13, or the two ends of the first positioning rail 13 are respectively used as fixture buckles 12.

Figure 7:
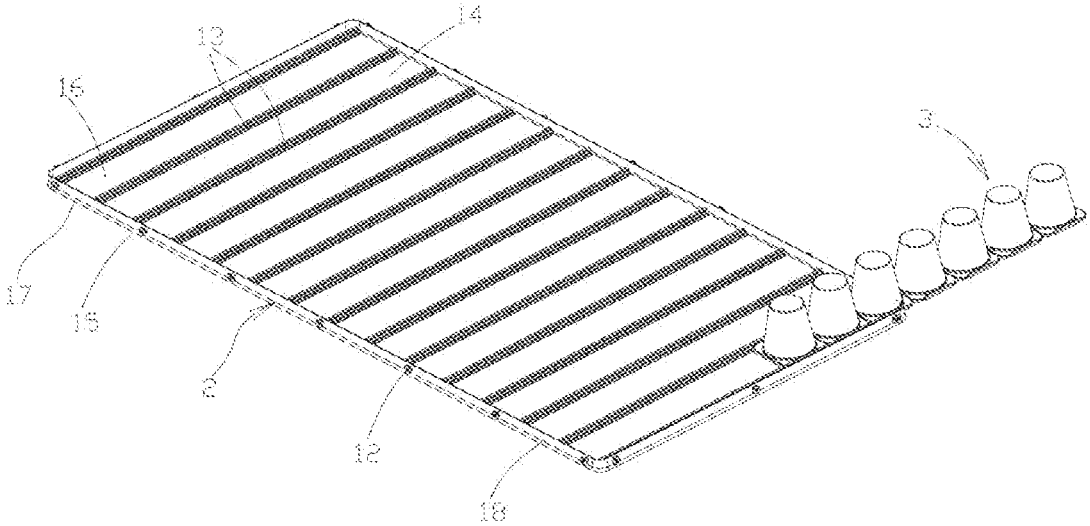
FIG. 7 is a schematic view of a structure wherein first elastic modules are mounted on a first elastic module mounting part of the elastic pad in FIG. 6.
Figure 8:
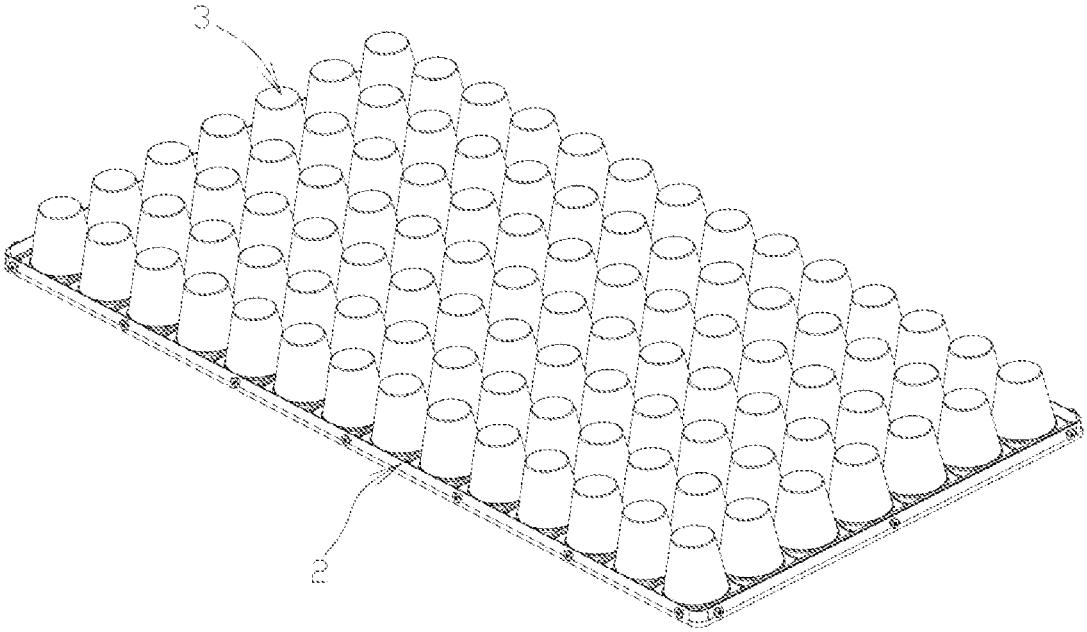
FIG. 8 is a schematic view of a structure wherein the first elastic modules are entirely mounted on the first elastic module mounting part of the elastic pad in FIG. 7.
Figure 9:
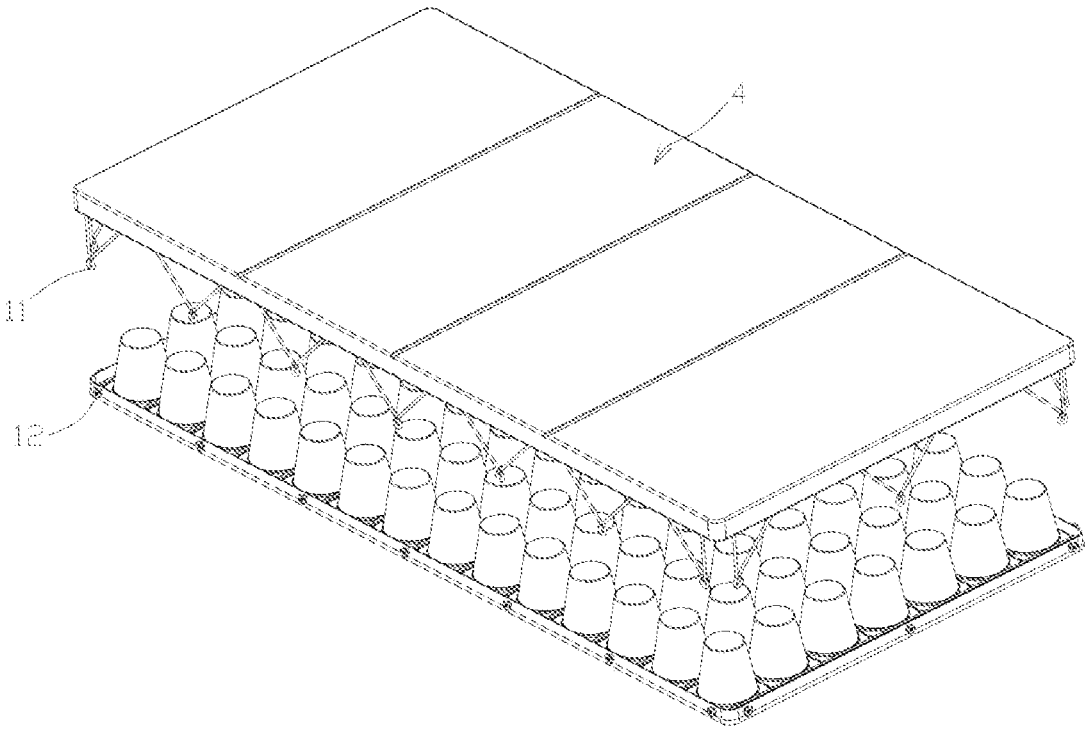
FIG. 9 is a schematic view of a structure wherein a pad layer covers the first elastic modules and is connected with the first elastic module mounting part via a first connection structure of the elastic pad in FIG. 6.
Figure 10:
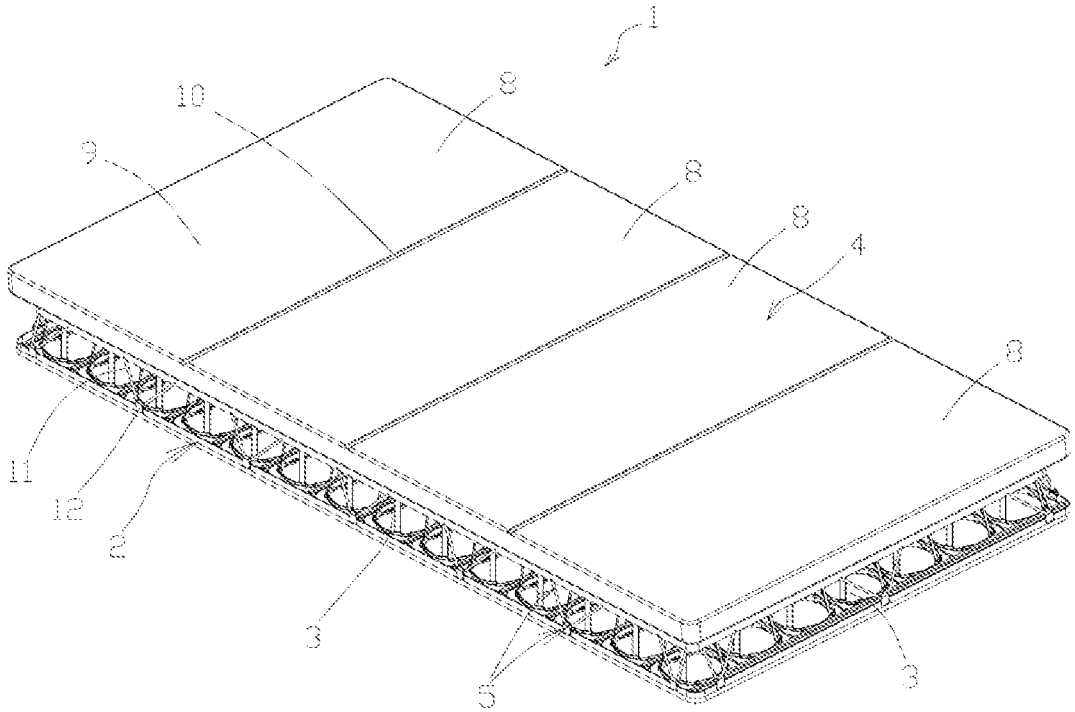
FIG. 10 is a three-dimensional view exemplarily illustrating a third type of elastic pad.
Figure 11:
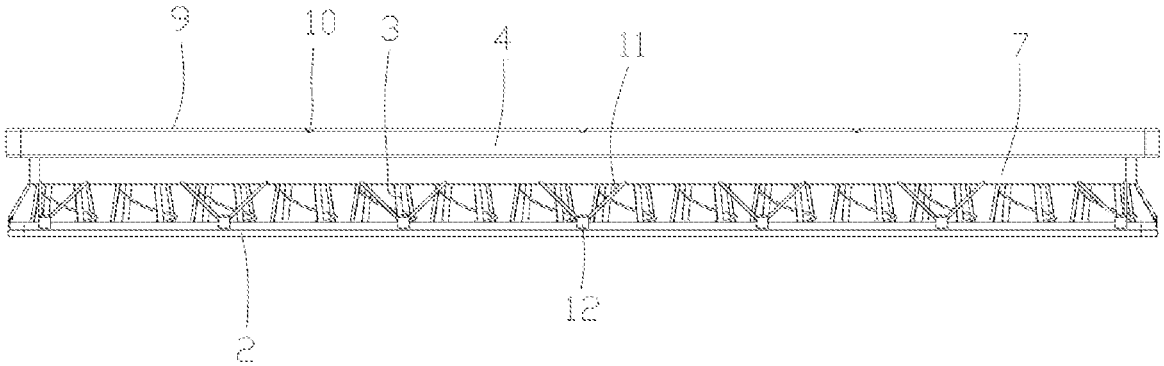
FIG. 11 is a schematic view of a front structure of the elastic pad of FIG. 10.
Figure 12:
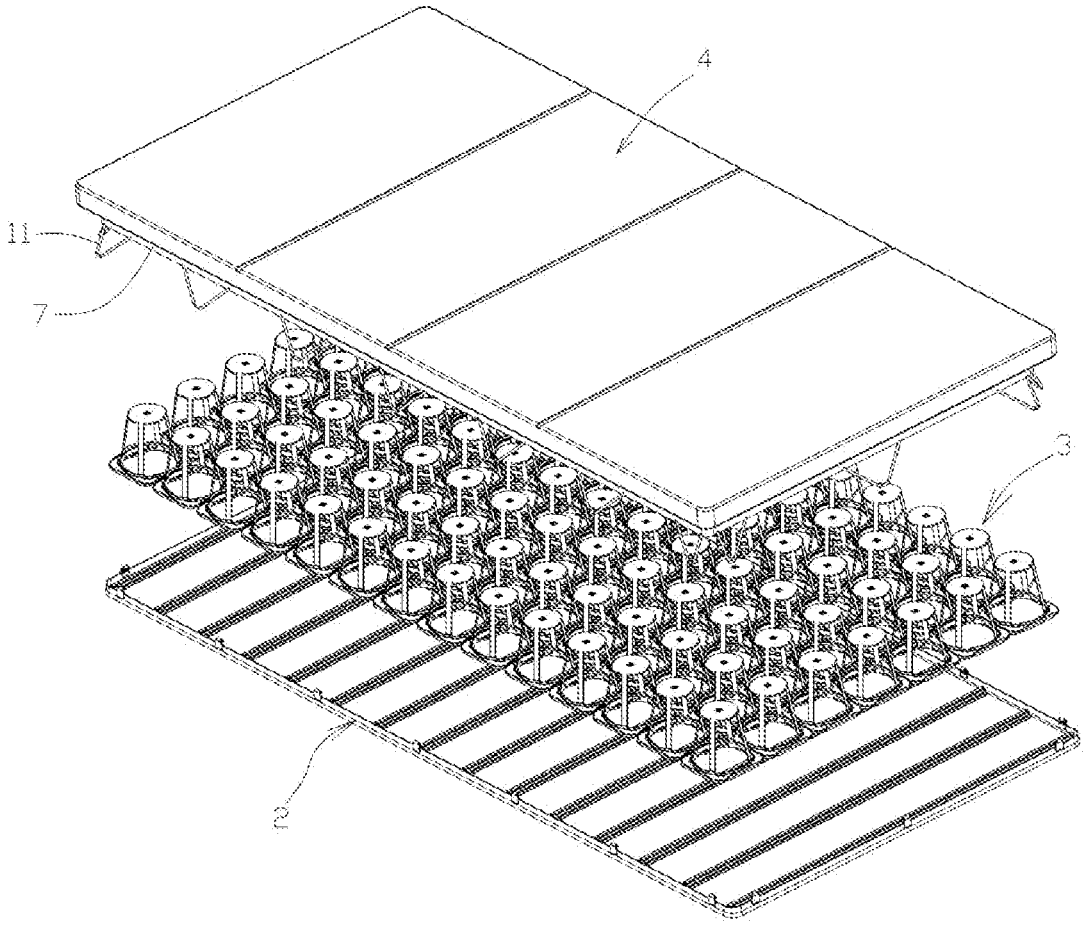
FIG. 12 is an exploded view of the elastic pad of FIG. 10.
Figure 13:
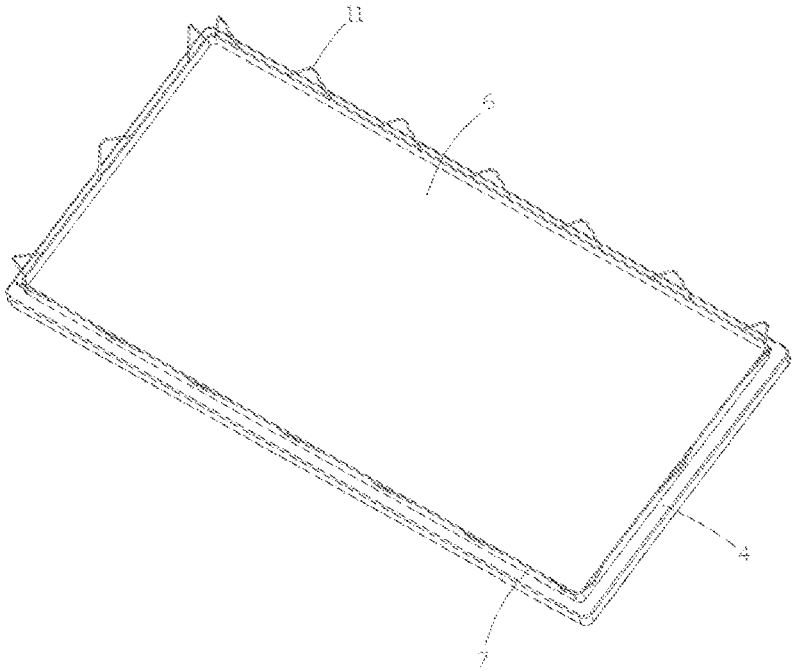
FIG. 13 is a schematic bottom view of the pad layer of the elastic pad in FIG. 10.

For another example, as a second type of the first elastic module mounting part 2, referring to FIG. 7, the first elastic module mounting part 2 includes a first base layer 15 that includes a first base layer upper surface 16 and a first base layer lower surface 17 opposing to each other in the height direction of the elastic pad; a plurality of first elastic modules 3 are disposed on the first base layer upper surface 16 (for example, the first elastic module 3 may be engaged, bonded or screwed onto the first base layer upper surface 16); the outer edge of the pad layer 4 and the outer edge of the first base layer 15 are connected via the first connection structure.

In order to enhance the stability of the first elastic modules 3, referring to FIG. 7, first stop edges 18 extending a predetermined height in the height direction of the elastic pad are disposed at the outer edge of the first base layer upper surface 16, a plurality of elastic modules 3 are located between the first stop edges 18, and the outer edge of the pad layer 4 and the first stop edges 18 are connected via the first connection structure. Therefore, the first stop edge 18 can stop movement of the first elastic modules 3. With the stopping function of the first stop edges 18, the stability of all of the first elastic modules 3 can be improved remarkably.

For another example, in a third type of the first elastic module mounting part 2, referring to FIG. 7, on the first base layer upper surface 16 of the first base layer 15 are disposed a plurality of first positioning rails 13 arranged at intervals in the length direction of the elastic pad, each first positioning rail 13 extends along the width direction of the elastic pad, and a first elastic module mounting area 14 is formed between adjacent first positioning rails 13, wherein, in the width direction of the elastic pad, each first elastic module 3 can form a sliding fit with the adjacent positioning rails 13 at either end of the adjacent first positioning rails 13 to slide into the first elastic module mounting area 14, and further slide along the first positioning rail 13 to a set position, so that each first elastic module mounting area 14 is provided with a plurality of first elastic modules 3 therein; wherein the plurality of first positioning rails 13 are located between the first stop edges 18, and the first stop edges 18 are configured to stop movement of the first elastic modules 3 in the width direction of the elastic pad. As such, with the stopping function of the first stop edges 18, the stability of all of the first elastic modules 3 can be enhanced remarkably. In addition, in order to further improve the stability of the first stop edges 18, in some embodiments, the first stop edges 18 are stop rings extending around the outer edge of the first base layer upper surface 16, and the stop rings are further flexible bodies and are retained a predetermined distance away from the outer peripheral surface of the first base layer 15. As the mutual pulling and limiting effect of the sidewalls of the stop rings, the stop rings can be stably retained in a vertical state to stably and reliably limit all the first elastic modules 3. The mutual pulling and limiting effect of the stop rings is particularly effective for the flexible stop edges. Since the stop rings are retained a predetermined distance from the outer peripheral surface of the first base layer 15, the flexible stop edges can be easily maintained in the vertical state unless a manual pulling force is applied to remove or place a plurality of first elastic modules 3. Therefore, this not only facilitates the storage of the first base layer 15, but also makes it possible to allow the first elastic modules 3 to slide into the respective first elastic module mounting areas 14 upon pulling the flexible stop edge outwards when the first elastic modules 3 are mounted.

FIGS. 17-22 show a fourth type of elastic pad 1. In the fourth type of elastic pad 1, referring to FIGS. 17-22, structures of the fourth type of elastic pad 1, other than the balance pad 19, may be the same or similar to the structures of other types of elastic pads 1. The fourth type of elastic pad 1 includes a balance pad 19, wherein the balance pad 19 is laid on a plurality of elastic modules 3 in the height direction of the elastic pad to limit the transverse movement of the plurality of first elastic modules 3, and the pad layer 4 is laid on the balance pad 19 in the height direction of the elastic pad. As all the first elastic modules 3 are transversely limited by the balance pad 19, the respective first elastic modules 3 can be mutually restricted to thus improve the stability of all of the first elastic modules 3. For example, in one structure of the balance pad 19, a plurality of through holes are formed on the balance pad 19, a portion of the respective first elastic modules 3 are received in the respective through holes. The balance pad 19 is more advantageous for higher first elastic modules 3, and by means of the balance pad 19, the stability of all of the first elastic modules 3 having a greater height can be improved significantly.

In the fourth type of elastic pad 1, the pad layer 4 can be placed on the balance pad 19. Alternatively, in order to improve the stability between the pad layer 4 and the balance pad 19, referring to FIGS. 21 and 22, the pad layer 4 and the balance pad 19 are connected via a positioning structure located therebetween. With the positioning structure, the reliability of the connection between the pad layer 4 and the balance pad 19 can be improved, to prevent unnecessary movement of the pad layer 4 relative to the balance pad 19.

For this elastic pad, it is worth noting that the positioning structure between the pad layer 4 and the balance pad 19 may be of multiple types. For example, as one type of the positioning structure, the positioning structure is a buckle structure including a female buckle and a male buckle mating with each other. For example, the female buckle of the buckle structure may be formed on the pad layer 4, and the male buckle of the buckle structure may be formed on the balance pad 19. With the mating of the female buckle and the male buckle, the pad layer 4 can be stably and reliably connected on the balance pad 19. For another example, as another type of the positioning structure, referring to FIGS. 21 and 22, the positioning structure includes Velcro tapes 21 disposed on the pad layer lower surface 6 of the pad layer 4 and/or the balance pad upper surface 20 of the balance pad 19. For instance, Velcro tapes 21 are disposed at multiple positions of the pad layer lower surface 6 of the pad layer 4, and Velcro tapes 21 are also disposed on multiple corresponding positions of the balance pad upper surface of the balance pad 19. With the cooperation of the Velcro tapes 21, the pad layer 4 can be stably and reliably connected on the balance pad 19. Alternatively, hook and loop (Velcro®) tape 21 is disposed at multiple positions on the balance pad upper surface of the balance pad 19. In this case, the lower surface of the pad layer 4 can be directly bonded to the plurality of Velcro tapes 21, to stably and reliably connect the pad layer 4 on the balance pad 19.

Figure 20:
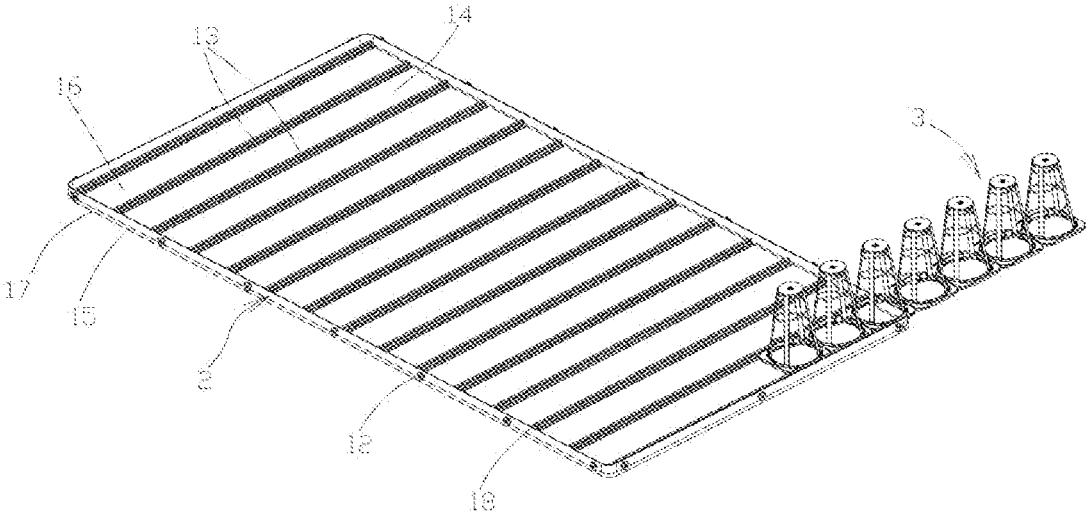
FIG. 20 is a schematic view of a structure wherein first elastic modules are mounted on a first elastic module mounting part of the elastic pad in FIG. 17.
Figure 21:
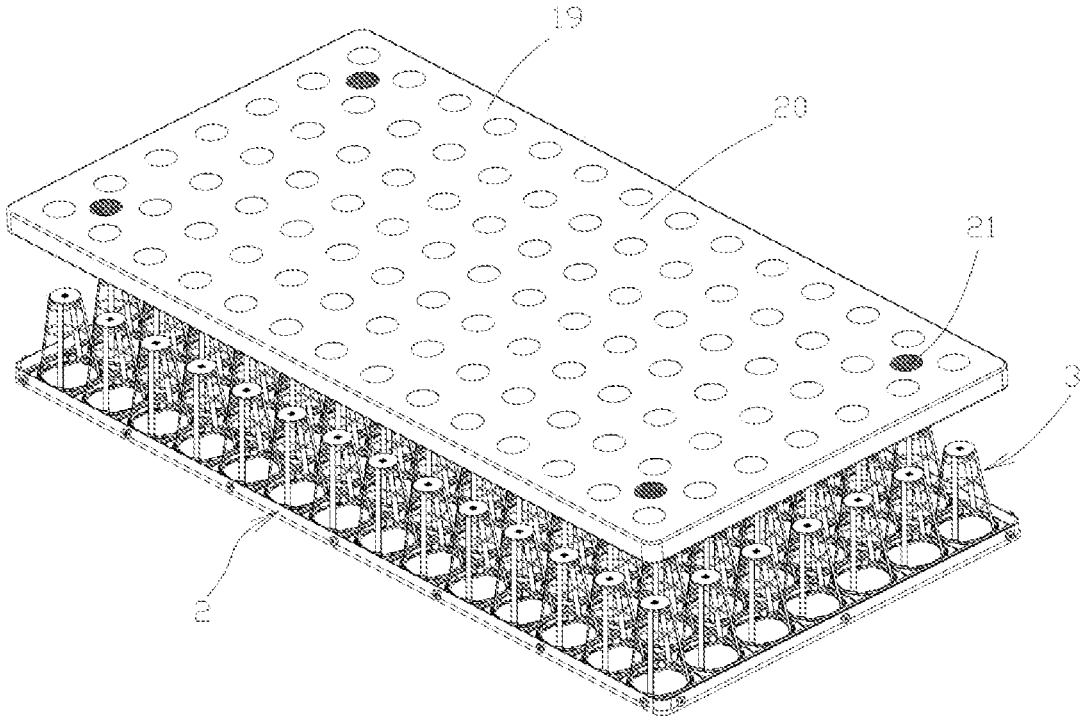
FIG. 21 is a schematic view of a structure wherein a balance pad is disposed on the first elastic modules of the elastic pad in FIG. 17.
Figure 22:
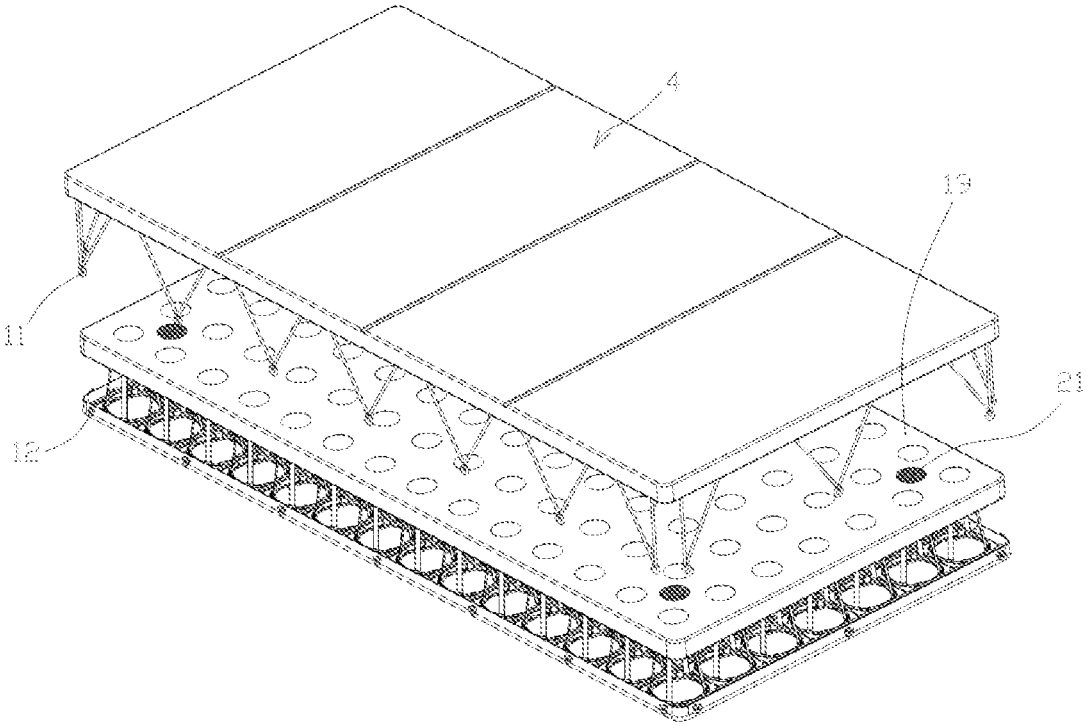
FIG. 22 is a schematic view of a structure wherein the pad layer covers the balance pad and is connected with the first elastic module mounting part via a first connection structure of the elastic pad in FIG. 17.
Figure 23:
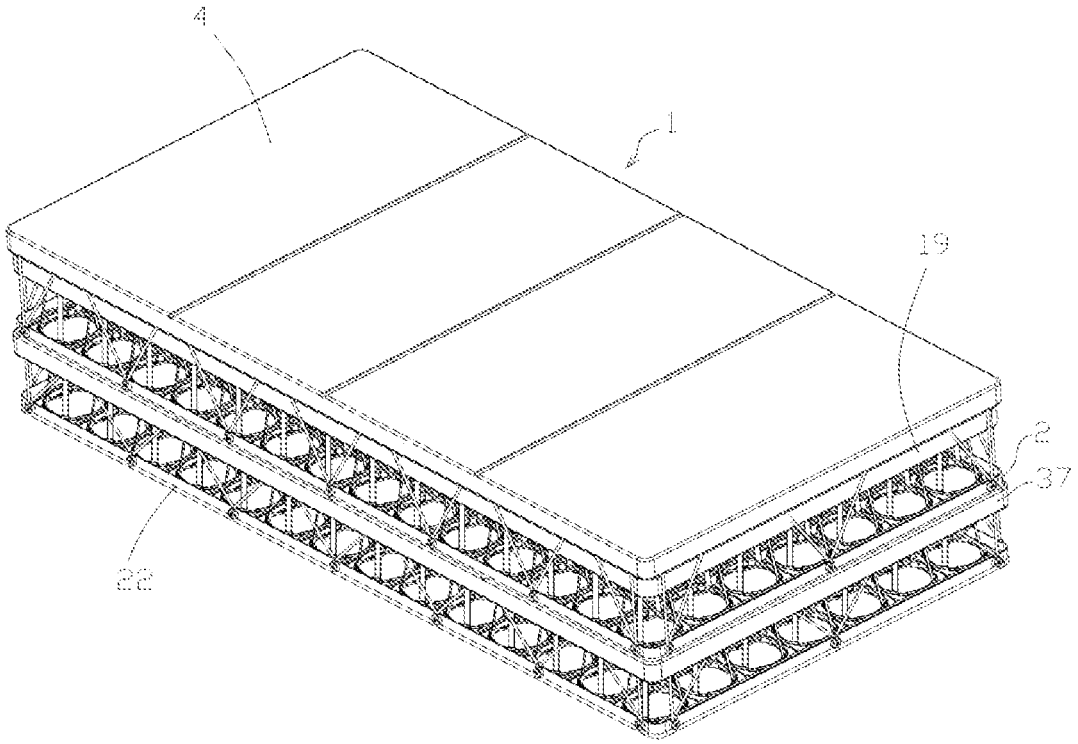
FIG. 23 is a three-dimensional view exemplarily illustrating a fifth type of elastic pad.

Referring to FIGS. 20-22, when the fourth type of elastic pad 1 is assembled, the plurality of elastic modules 3 are disposed on the first elastic module mounting part 2 to form a predetermined arrangement pattern, the balance pad 19 covers all of the first elastic modules 3 to limit the transverse movement of all of the first elastic modules 3, the pad layer 4 covers the balance pad 19, the pad layer 4 and the first elastic module mounting part 2 are then connected via the first connection structure 5, and the fourth type of elastic pad 1 is finally assembled. In this way, the elastic pad 1 exhibits excellent performance in balance, and can be simply assembled and assembled. Since no enclosing side surrounding cover is used, the elastic pad 1 has an open or permeable inner structure and an excellent ventilation performance, which is suitable for outdoor use.

FIGS. 23-30 show a fifth type of elastic pad 1. On the basis of any one type of the above-mentioned elastic pads 1, the fifth type of elastic pad 1 further includes the following structure. Referring to FIGS. 23-30, the fifth type of elastic pad 1 further includes a second elastic module mounting part 22 and a plurality of elastic modules 23, wherein the plurality of second elastic modules 23 are arranged on the second elastic module mounting part 22 in a predetermined manner in the height direction of the elastic pad, to form a predetermined arrangement pattern. The first elastic module mounting part 2 is laid on the plurality of second elastic modules 23 in the height direction of the elastic pad, and the outer edge of the second elastic module mounting part 22 and the outer edge of the first elastic module mounting part 2 are connected via a releasable second connection structure 24. As shown the elastic pad has no enclosing side surrounding cover. Therefore, a double-layer elastic pad can be assembled, and with the first connection structure and the second connection structure, the elastic pad can simply assembled and disassembled. In addition, the elastic pad has a permeable inner structure and an excellent ventilation performance, which can greatly improve the comfort of the elastic pad.

In the elastic pad 1, the second connection structure 24 may be identical to the first connection structure 5, i.e., the above description about the first connection structure 5 is also applicable to the second connection structure 24. Alternatively, the second connection structure 24 may be different from the first connection structure 5.

The first elastic module 3 and the second elastic module 23 are the same in height. Alternatively, in some embodiments, referring to FIGS. 24, 26 and 28, the height of the first elastic module 3 is greater than the height of the second elastic module 23, wherein the elastic pad includes a balance pad 19, the balance pad 19 is laid on the plurality of first elastic modules 3 in the height direction of the elastic pad to limit the transverse movement of the plurality of first elastic modules 3, and the pad layer 4 is laid on the balance pad 19 in the height direction of the elastic pad. As the balance pad 19 transversely limits all of the first elastic modules 3, the respective first elastic modules 3 can be mutually restricted to thus improve the stability of all of the first elastic modules 3.

In the fifth type of elastic pad 1, the pad layer 4 may be placed on the balance pad 19. Alternatively, in order to improve the stability between the pad layer 4 and the balance pad 19, referring to FIGS. 29 and 30, the pad layer 4 and the balance pad 19 are connected via a positioning structure located therebetween. With the positioning structure, the reliability of the connection between the pad layer 4 and the balance pad 19 can be improved, to prevent unnecessary movement of the pad layer 4 relative to the balance pad 19.

In the fifth type of elastic pad 1, it is worth noting that the positioning structure between the pad layer 4 and the balance pad 19 may be of multiple types. For example, as one type of the positioning structure, the positioning structure is a buckle structure including a female buckle and a male buckle mating with each other. For example, the female buckle of the buckle structure may be formed on the pad layer 4, and the male buckle of the buckle structure may be formed on the balance pad 19. With the mating of the female buckle and the male buckle, the pad layer 4 can be stably and reliably connected on the balance pad 19. For another example, as another type of the positioning structure, referring to FIGS. 29 and 30, the positioning structure includes Velcro tapes 21 disposed on the pad layer lower surface 6 of the pad layer 4 and/or the balance pad upper surface 20 of the balance pad 19. For instance, Velcro tapes 21 are disposed at multiple positions of the pad layer lower surface 6 of the pad layer 4, and Velcro tapes 21 are also disposed on multiple corresponding positions of the balance pad upper surface 20 of the balance pad 19. With the cooperation of the Velcro tapes 21, the pad layer 4 can be stably and reliably connected on the balance pad 19. Alternatively, Velcro tapes 21 are disposed at multiple positions on the balance pad upper surface 20 of the balance pad 19. In the circumstance, the lower surface of the pad layer 4 can be directly bonded to the plurality of Velcro tapes 21, to stably and reliably connect the pad layer 4 on the balance pad 19.

In the fifth type of elastic pad 1, the first elastic module mount part 2 may be directly laid on all of the second elastic modules 23. Alternatively, referring to FIG. 24, the elastic pad 1 further includes a support layer 37 laid on the plurality of second elastic modules 23, the support layer 37 may be the same as the pad layer 4 or may be other pad layer, and the outer edge of the second elastic module mounting part 22 and the outer edge of the support layer 37 are connected via a second connection structure 24; wherein the first elastic module mounting part 2 is connected on the upper surface of the support layer 37. For example, the first elastic module mounting part 2 may be ultrasonically welded, sewn or zipped onto the support layer 37. The support layer 37 may play a buffering role between the second elastic module 23 and the first elastic module mounting part 2, to prevent vibration influence from being generated between the second elastic module 23 and the first elastic module 3 and thus improve the overall stability and comfort of the elastic pad 1.

Figure 24:
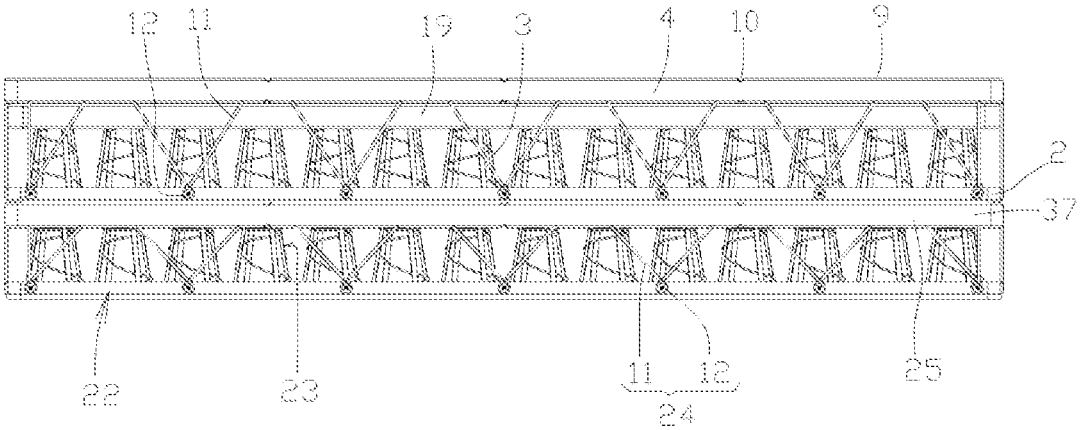
FIG. 24 is a schematic view of a front structure of the elastic pad in FIG. 23.

In the fifth type of elastic pad 1, referring to FIG. 24, the outer edge of the support layer 37 includes a second stop ring 25 extending out towards the second elastic module mounting part 22 in the mounted state, and the second stop ring 25 is configured to enclose the second elastic module 23 located at the outermost side of the elastic pad, wherein the outer edge of the second elastic module mounting part 22 and the second stop ring 25 are connected via the second connection structure 24. In this way, after the second connection structure 24 (e.g. the connection rope 11 and the fixture buckle 12) in its surrounding connects the second stop ring 25 and the second elastic module mounting part 22, the second connection structure 24 may tighten the second stop ring to cause the second stop ring 25 in the tensioned state to stop movement of the second elastic module 23, thus improving the stability between the second elastic module 23 and the support layer 37 and improving the comfort.

The second stop ring 25 may be welded, sewn or zipped to the support layer 37.

In the fifth type of elastic pad 1, the second stop ring 25 may be connected at the outer peripheral surface of the support layer 37. Alternatively, the second stop ring is at a predetermined distance from the outer periphery of the support layer 37. In this way, the second connection structure 24 tightens the second stop ring 25 so that the second stop ring 25, when being in the tensioned state, can stop movement of the second elastic module 23 more effectively.

In the fifth type of elastic pad 1, the second elastic module mounting part 22 may be the same as the first elastic module mounting part 2, or may be different from the first elastic module mounting part 2.

Figure 26:
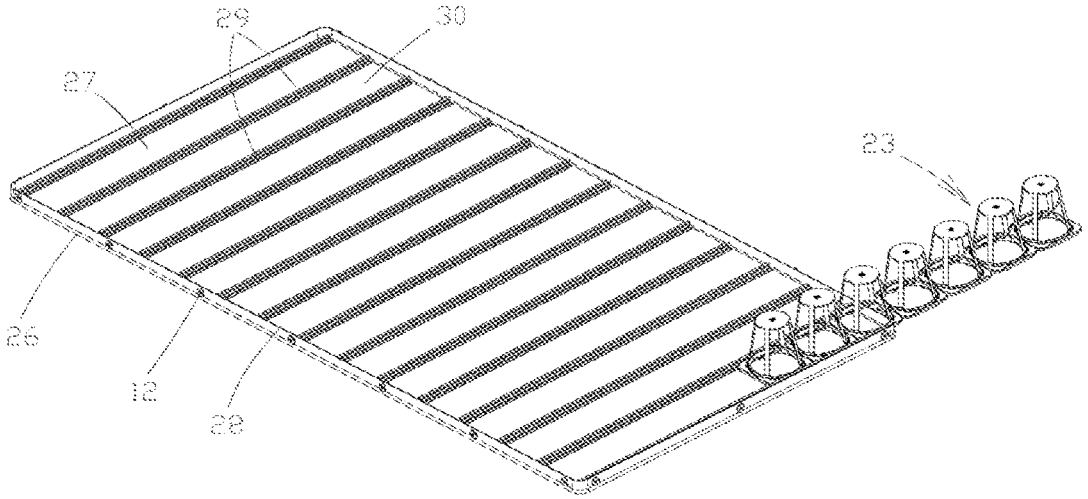
FIG. 26 is a schematic view of a structure wherein second elastic modules are mounted on a second elastic module mounting part of the elastic pad in FIG. 23.
Figure 27:
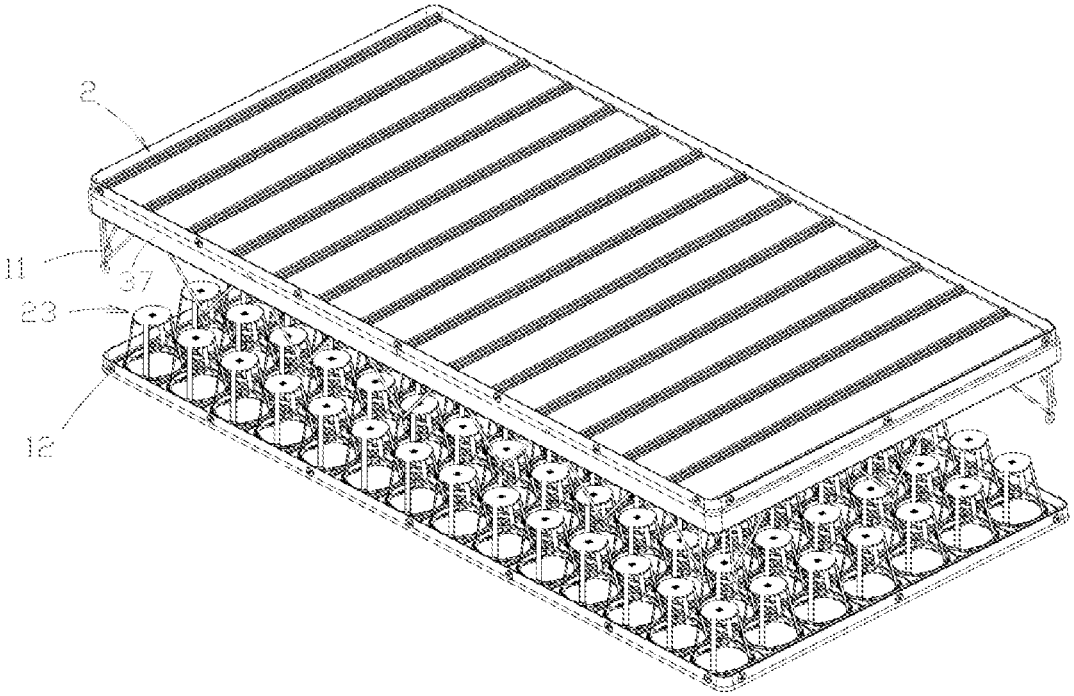
FIG. 27 is a schematic view of a structure wherein the first elastic module mounting part is disposed on second elastic modules and is connected with a second elastic module mounting part via a second connection structure of the elastic pad in FIG. 23.
Figure 28:
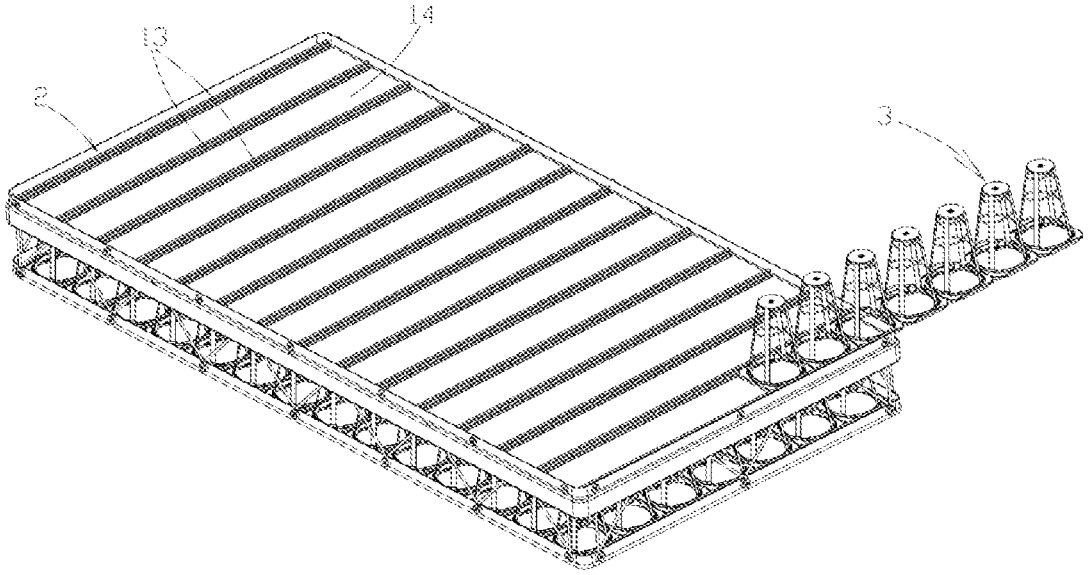
FIG. 28 is a schematic view of a structure wherein the first elastic modules are mounted on the first elastic module mounting part of the elastic pad in FIG. 23.
Figure 29:
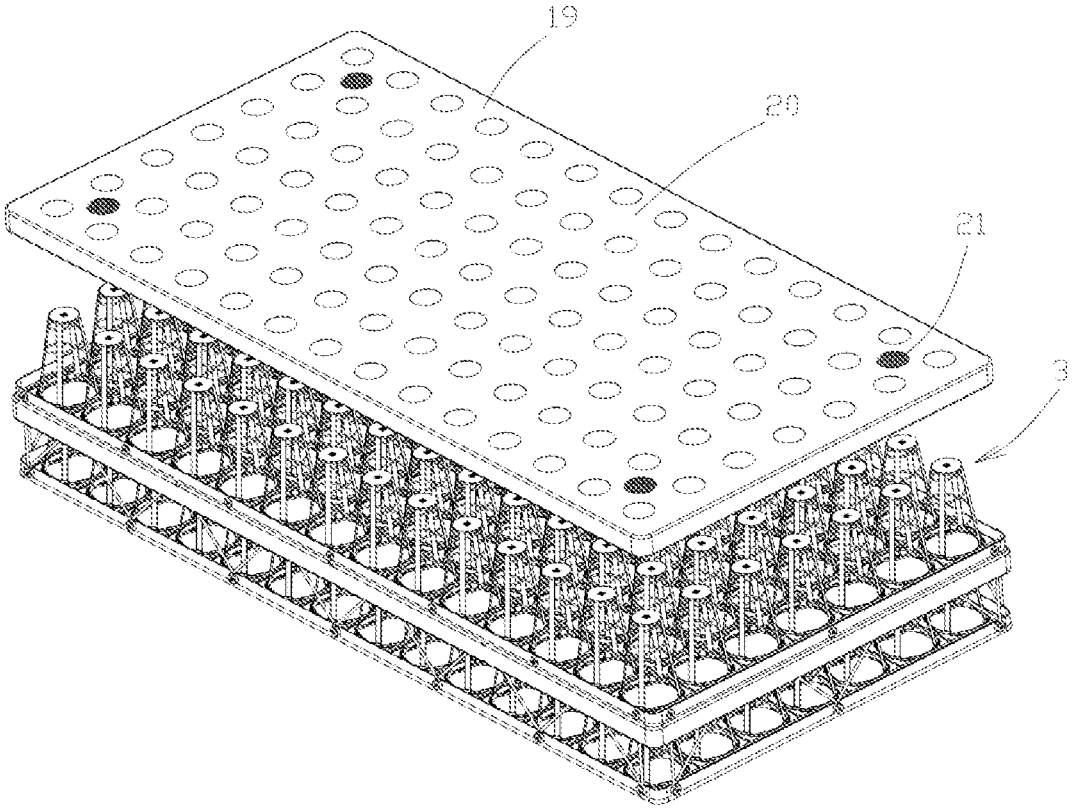
FIG. 29 is a schematic view of a structure wherein a balance pad is disposed on the first elastic modules of the elastic pad in FIG. 23.
Figure 30:
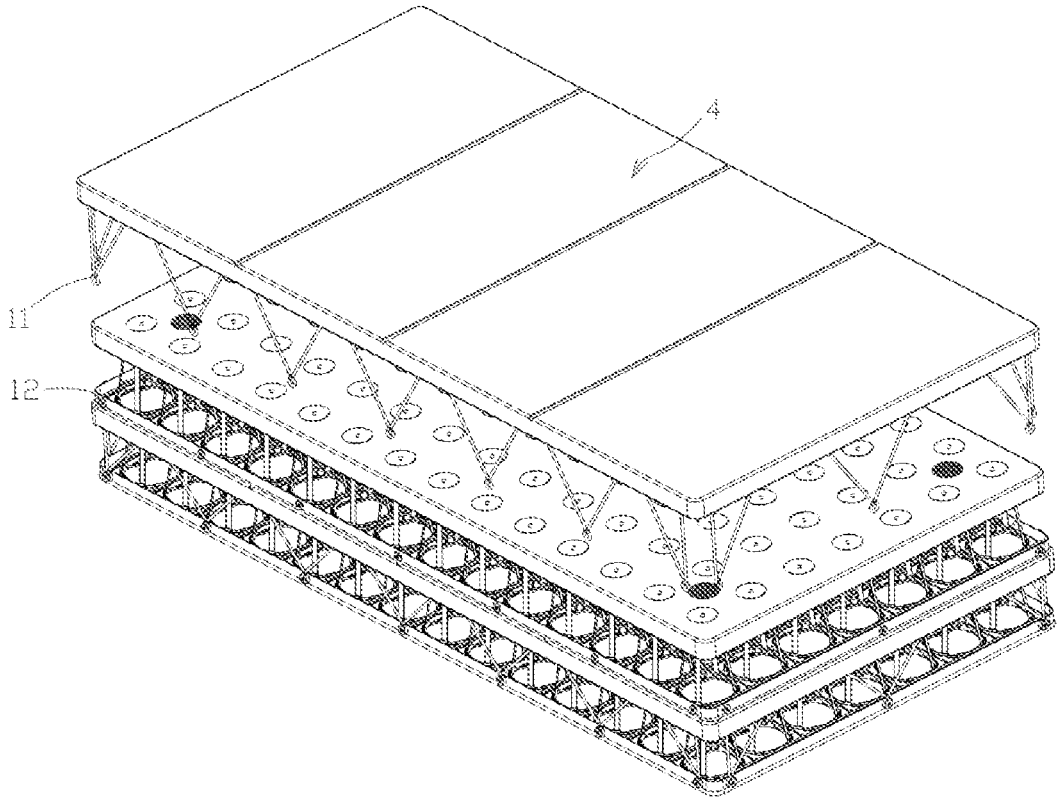
FIG. 30 is a schematic view of a structure wherein a pad layer covers the balance pad and is connected with the first elastic module mounting part via a first connection structure of the elastic pad in FIG. 23.
Figure 31:
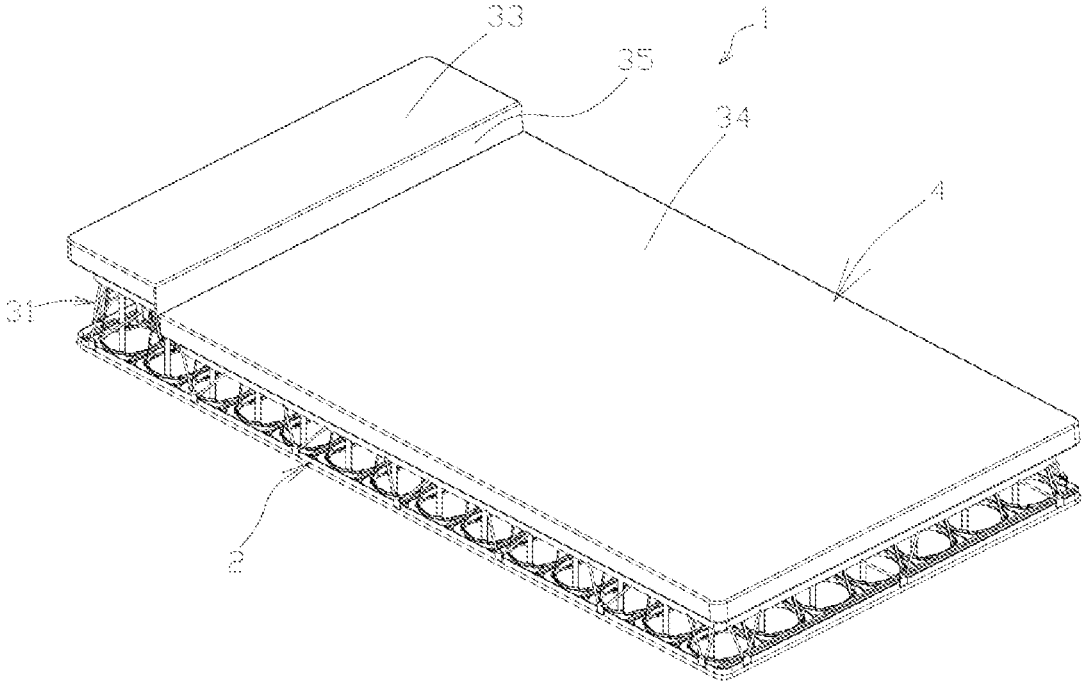
FIG. 31 is a three-dimensional view exemplarily illustrating a sixth type of elastic pad.
Figure 32:
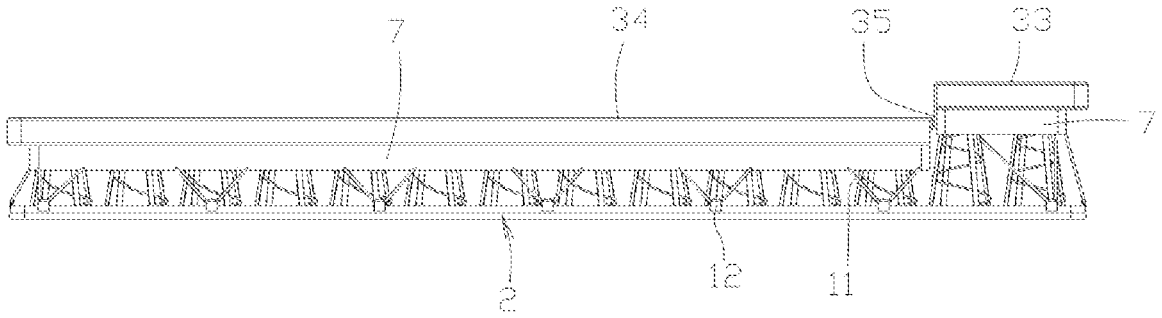
FIG. 32 is a schematic view of a front structure of the elastic pad in FIG. 31.
Figure 33:
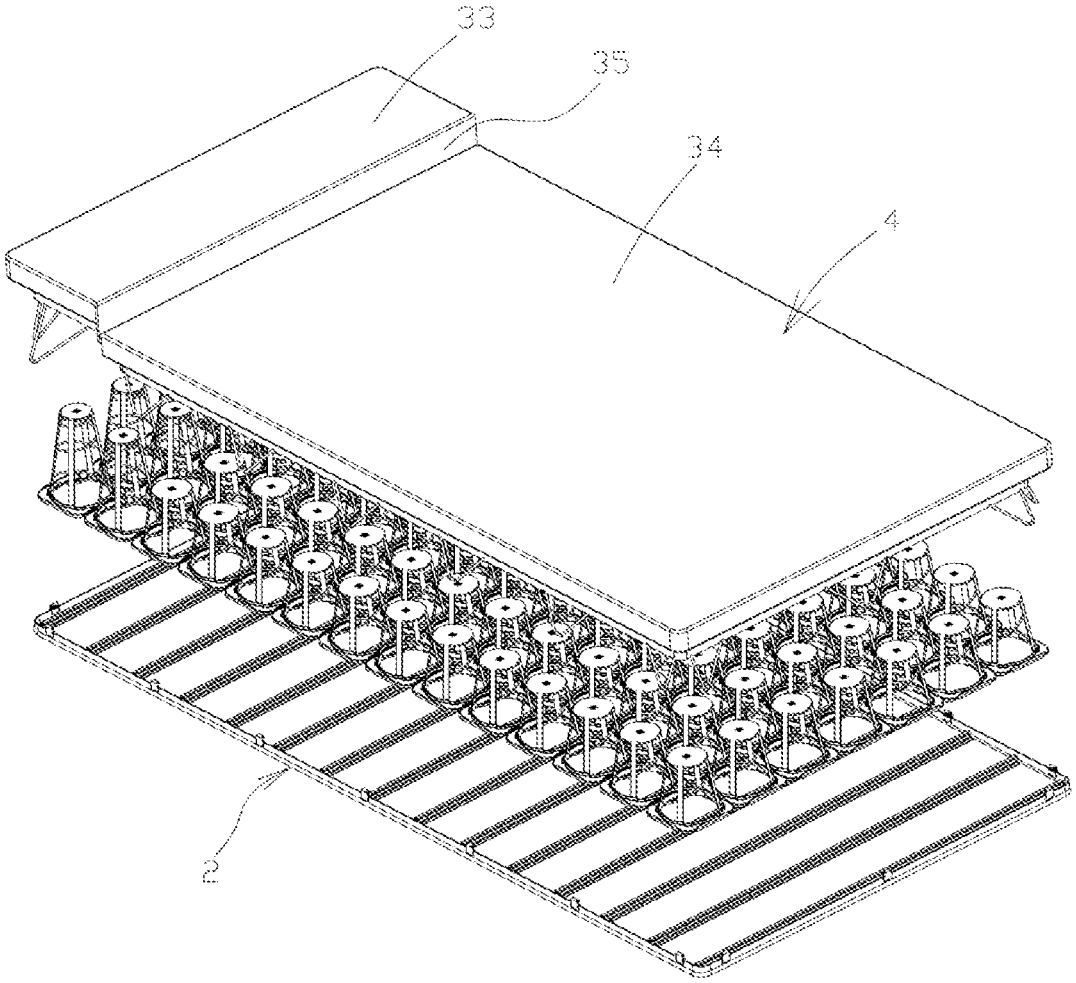
FIG. 33 is an exploded view of the elastic pad in FIG. 31.
Figure 34:
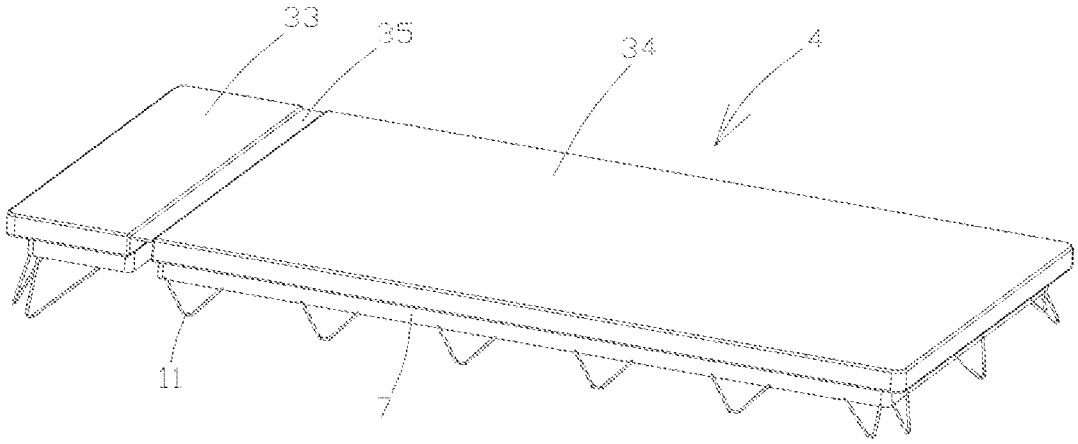
FIG. 34 is a schematic view of a state of a pad layer of the elastic pad in FIG. 31.
Figure 35:
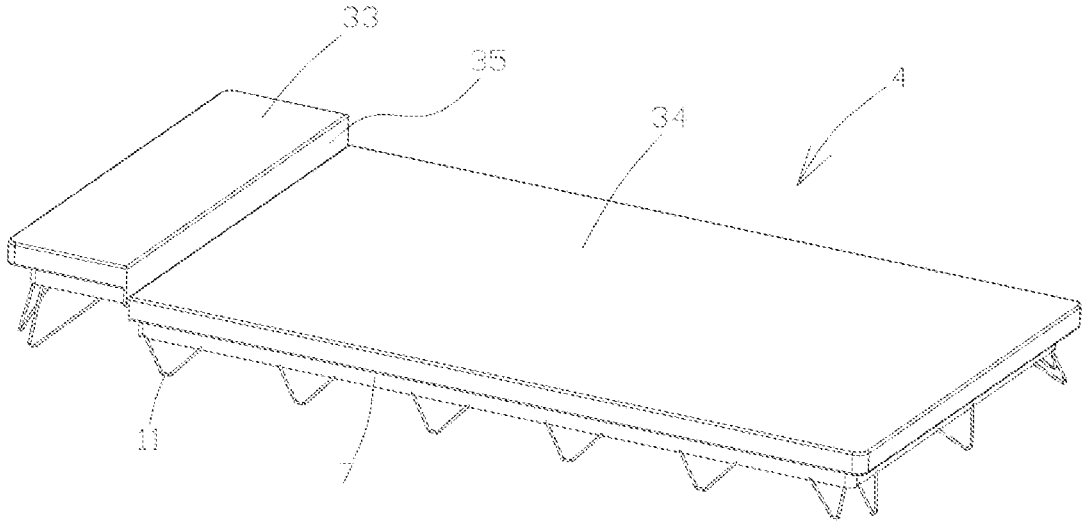
FIG. 35 is a schematic view of another state of the pad layer in FIG. 34.
Figure 36:
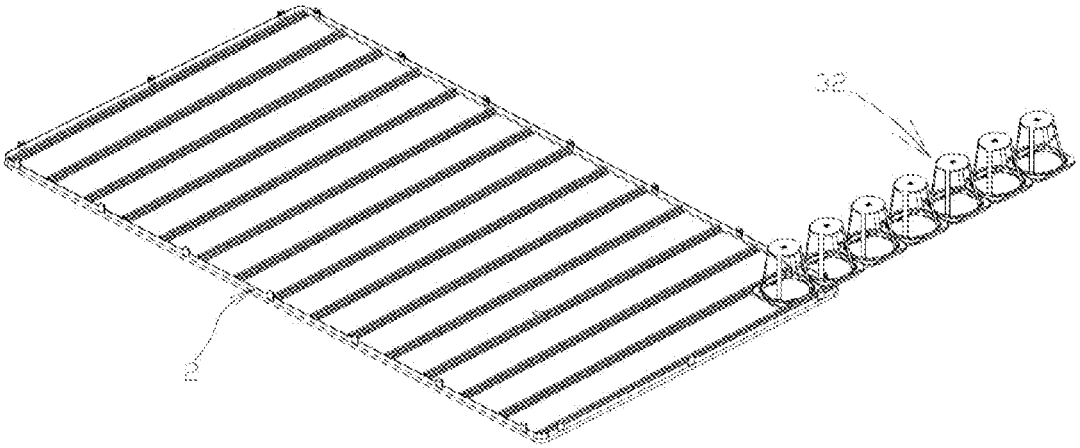
FIG. 36 is a schematic view of a structure wherein a second module group is mounted on a first module mounting part of the elastic pad in FIG. 31.
Figure 37:
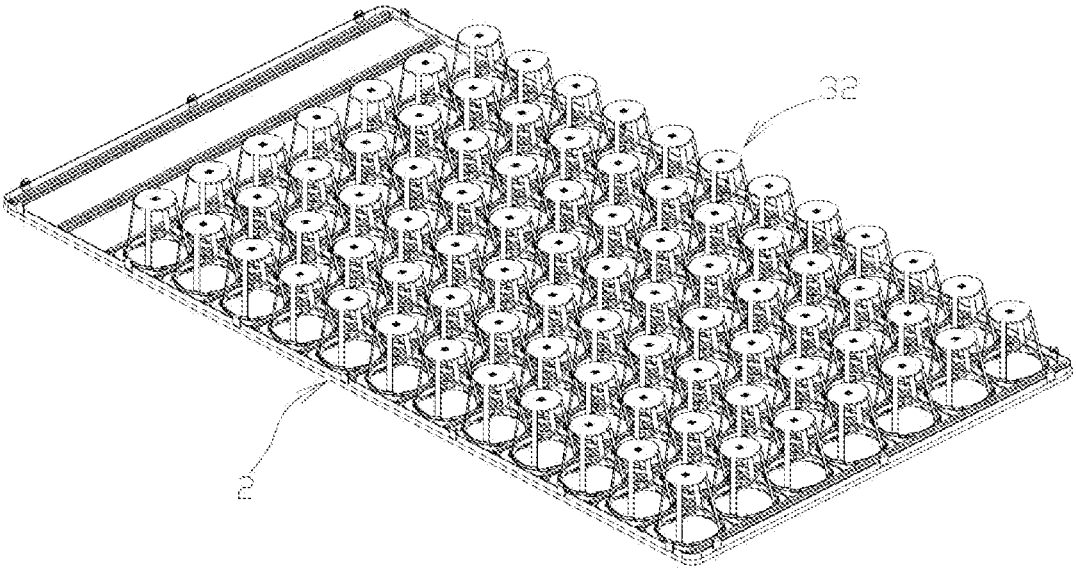
FIG. 37 is a schematic view of a structure wherein the second module group is entirely mounted on the first module mounting part of the elastic pad in FIG. 36.
Figure 38:
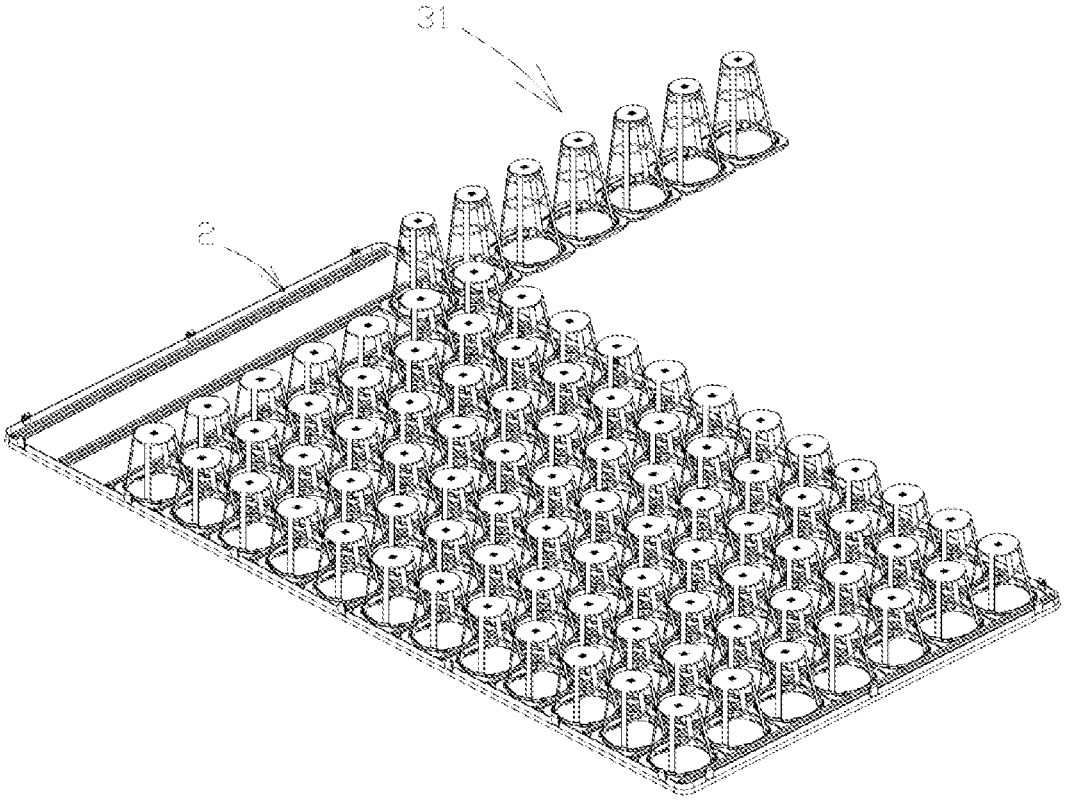
FIG. 38 is a schematic view of a structure wherein a first module group is mounted on a first module mounting part of the elastic pad in FIG. 31.
Figure 39:
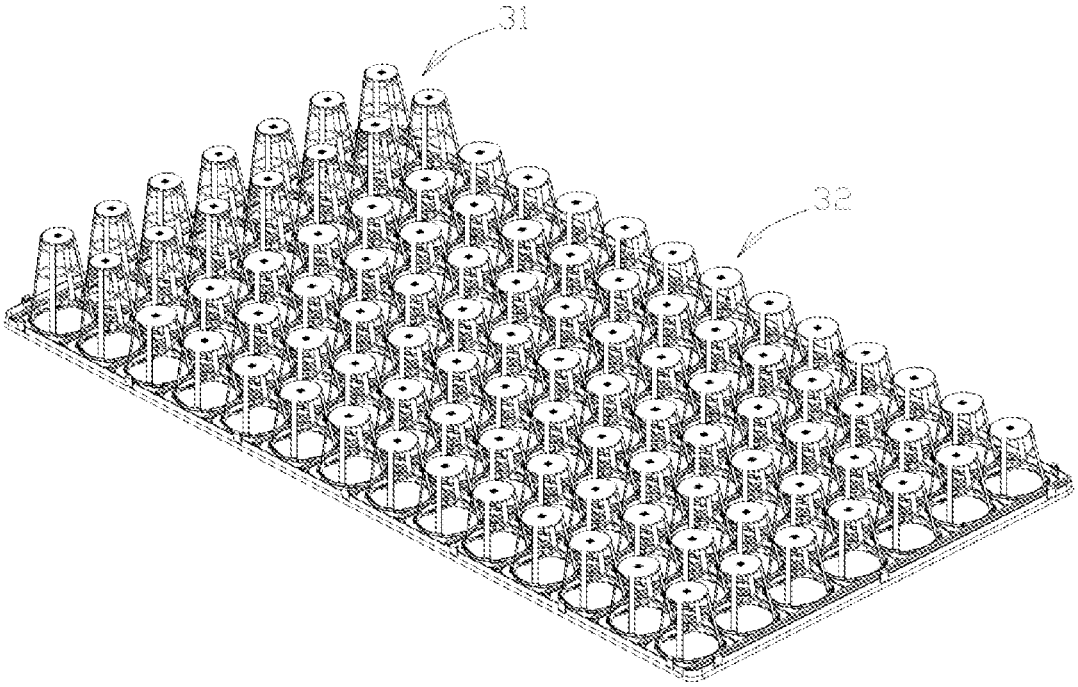
FIG. 39 is a schematic view of a structure wherein the first module group is entirely mounted on the first module mounting part of the elastic pad in FIG. 38.
Figure 40:
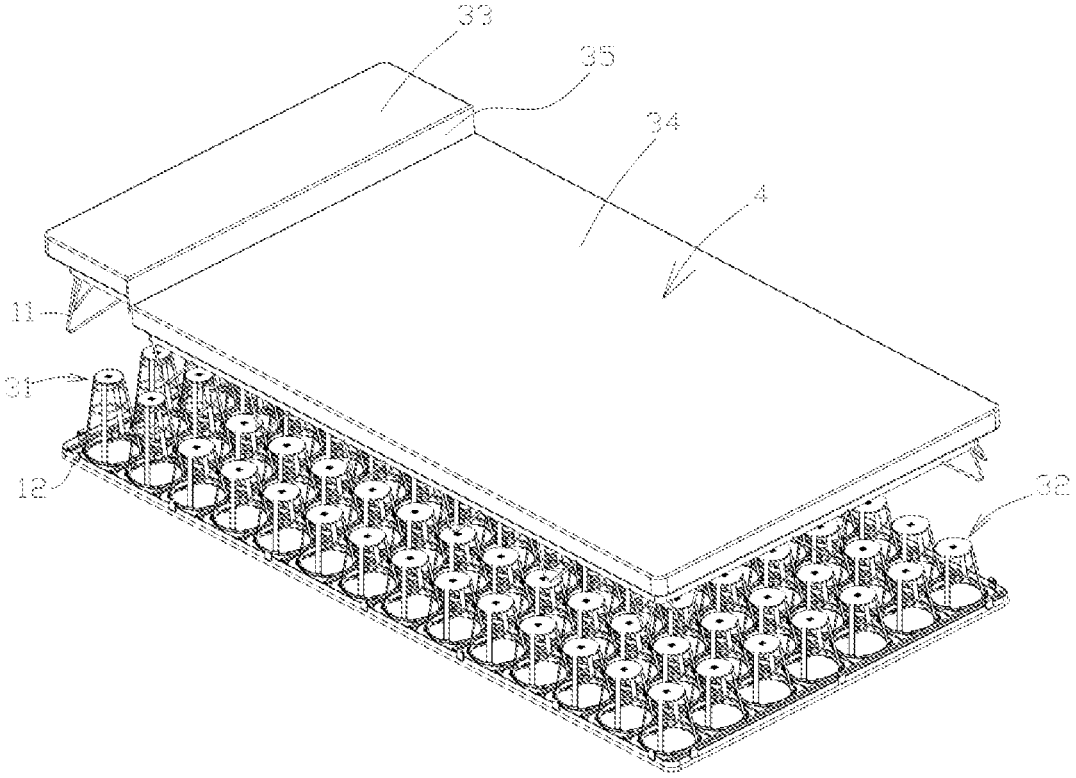
FIG. 40 is a schematic view of a structure wherein the pad layer is laid on a first module group and a second module group and is connected with a first elastic module mounting part via a first connection structure of the elastic pad in FIG. 31.

For example, as one type of the second elastic module mounting part 22, referring to FIG. 26, the second elastic module mounting part 22 includes a second base layer 26, and the second base layer 26 includes a second base layer upper surface 27 and a second base layer lower surface opposing to each other in the height direction of the elastic pad, wherein the plurality of second elastic modules 23 are disposed on the second base layer upper surface 27 (for example, the second elastic modules 23 may be engaged, bonded or screwed onto the second base layer upper surface 27), and the outer edge of the second base layer 26 is connected with the second connection structure.

In order to improve the stability of the second elastic module 23, referring FIG. 26, at the outer edge of the second base layer upper surface 27 are disposed second stop edges 28 extending a predetermined height in the height direction of the elastic pad, a plurality of elastic modules 23 are located between the second stop edges 28, and the second stop edges 28 are connected with the second connection structure. Therefore, the second stop edges 28 can stop movement of the second elastic modules 23. With the stopping function of the second stop edges 28, the stability of all of the second elastic modules 23 can be improved remarkably.

For another example, in another type of the second elastic module mounting part 22, referring to FIG. 26, on the second base layer upper surface 27 are disposed a plurality of second positioning rails 29 arranged at intervals in the length direction of the elastic pad, each second positioning rail 29 extends along the width direction of the elastic pad, and a second elastic module mounting area 30 is formed between adjacent second positioning rails 29, wherein, in the width direction of the elastic pad, each second elastic module 23 can form a sliding fit with the adjacent second positioning rails 29 at either end of the adjacent second positioning rails 29 to slide into the second elastic module mounting area 30, and further slide along the second positioning rail 29 to a set position, so that each second elastic module mounting area 30 is provided with a plurality of second elastic modules 23 therein; wherein the plurality of second positioning rails 29 are located between the second stop edges 28, and the second stop edges 28 are configured to stop movement of the second elastic modules 23 in the width direction of the elastic pad. As such, with the stopping function of the second stop edges 28, the stability of all of the second elastic modules 23 can be enhanced remarkably. In addition, in order to further improve the stability of the second stop edges 28, in some embodiments, the second stop edges 28 are stop rings extending around the outer edge of the second base layer upper surface 27, and the stop rings are flexible bodies and are retained a predetermined distance away from the outer peripheral surface of the second base layer 26. As the mutual pulling and limiting effect of the sidewalls of the stop rings, the stop rings can be stably retained in a vertical state, so as to stably and reliably limit all of the second elastic modules 23. The mutual pulling and limiting effect of the stop rings is particularly effective for the flexible stop edges. Since the stop rings are retained a predetermined distance from the outer peripheral surface of the second base layer 26, the flexible stop edges can be easily maintained in the vertical state unless a manual pulling force is applied to remove or place a plurality of second elastic modules 23. Therefore, this not only facilitates the storage of the second base layer 26, but also makes it possible to allow the second elastic modules 23 to slide into the respective second elastic module mounting areas 30 upon pulling the flexible stop edge outwards when the second elastic modules 23 are mounted.

Referring to FIGS. 26-30, when the fifth type of elastic pad 1 is assembled, the plurality of second elastic modules 23 are disposed on the second elastic module mounting part 22 to form a predetermined arrangement pattern, the first elastic module mounting part 2 is laid on all of the second elastic modules 23 and connected with the second elastic module mounting part 22 via the second connection structure 24, the plurality of first elastic modules 3 are then disposed on the first elastic module mounting part 2 to form a predetermined arrangement pattern, the balance pad 9 covers all of the first elastic modules 3 to limit the transverse movement of all of the first elastic module 3, the pad layer 4 covers the balance pad 19, the pad layer 4 and the first elastic module mounting part 2 are then connected via the first connection structure 5, and the fifth type of elastic pad 1 is finally assembled. In this way, the elastic pad 1 exhibits excellent performance in balance, and can be simply assembled and disassembled. Since an enclosing side surrounding cover is not used, the elastic pad 1 has a permeable inner structure and an excellent ventilation performance, which is suitable for outdoor use.

FIGS. 31-40 show a sixth type of elastic pad 1. In the sixth elastic pad 1, referring to FIG. 39, a plurality of first elastic modules 3 are divided into a first module group 31 and a second module group 32 arranged in the length direction of the elastic pad, wherein a plurality of first elastic modules 3 in the first module group 31 have a height greater than a plurality of first elastic modules 3 in the second module group 32, and the pad layer 4 is laid on the first module group 31 and the second module group 32 so that a first pad layer area 33 corresponding to the first module group 31 and a second pad layer area 34 corresponding to the second module group 32 are formed on the pad layer due to the height difference between the first module group 31 and the second module group 32, and wherein the first pad layer area 33 is higher than the second pad layer area 34, and the area of the first pad layer area 33 is smaller than the area of the second pad layer area 34. Therefore, the first pad layer area 33 may be a pillow or headrest area, to improve comfort.

In the sixth type of elastic pad 1, the pad layer 4 may be a piece of pad layer. Alternatively, in order to improve the flatness and comfort, referring to FIGS. 34 and 35, the first pad layer area 33 is connected with the second pad layer area 34 via a flexible hinge part 35. In the case, referring to FIG. 40, after the pad layer 4 is laid on the first module group 31 and the second module group 34, the first pad layer area 33 and the second pad layer area 34 may be more smoothly covered on the first module group 31 and the second module group 32 via the flexible hinge part 35, respectively, to prevent a slope from being generated on the pad layer between the first module group 31 and the second module group 32 to thus affect the comfort.

The sixth type of elastic pad 1 includes a balance pad (not shown) that is laid on the plurality of first elastic modules 3 of the first module group 31 in the height direction of the elastic pad to limit the transverse movement of the first module group 31, and the first pad layer area 33 is laid on the balance pad in the height direction of the elastic pad. Therefore, with the balance pad, the overall stability of the first module group 31 can be further improved.

Figure 41:
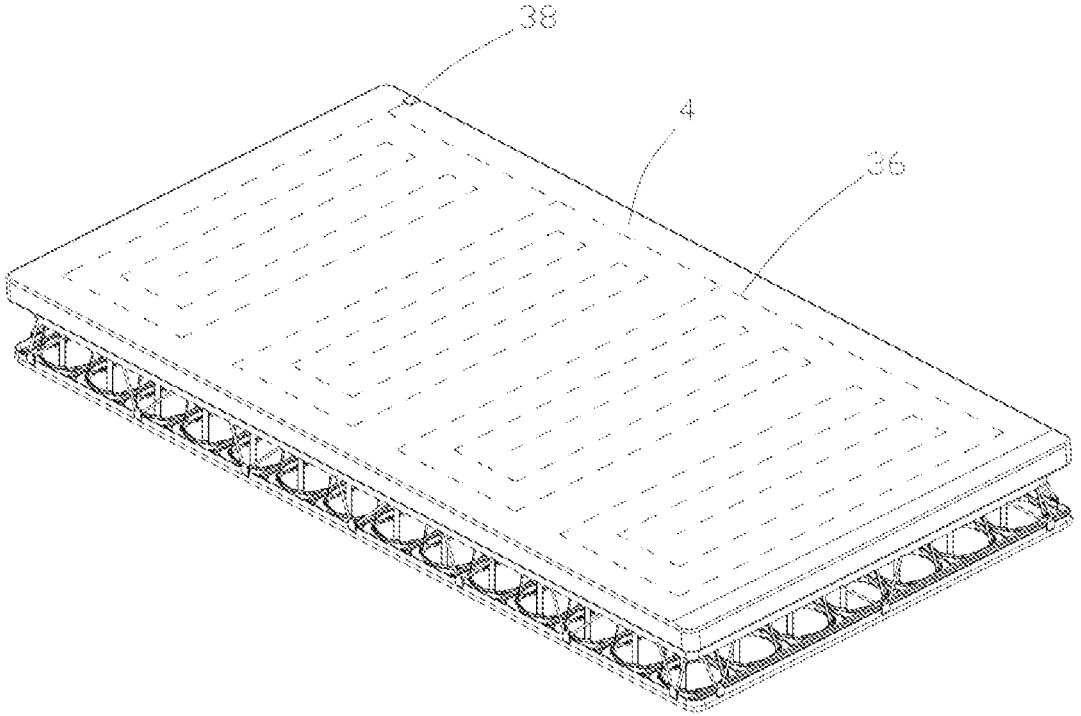
FIG. 41 is a schematic view of a structure wherein a pad layer of an elastic pad according to the present invention is provided therein with heating elements.
Figure 42:
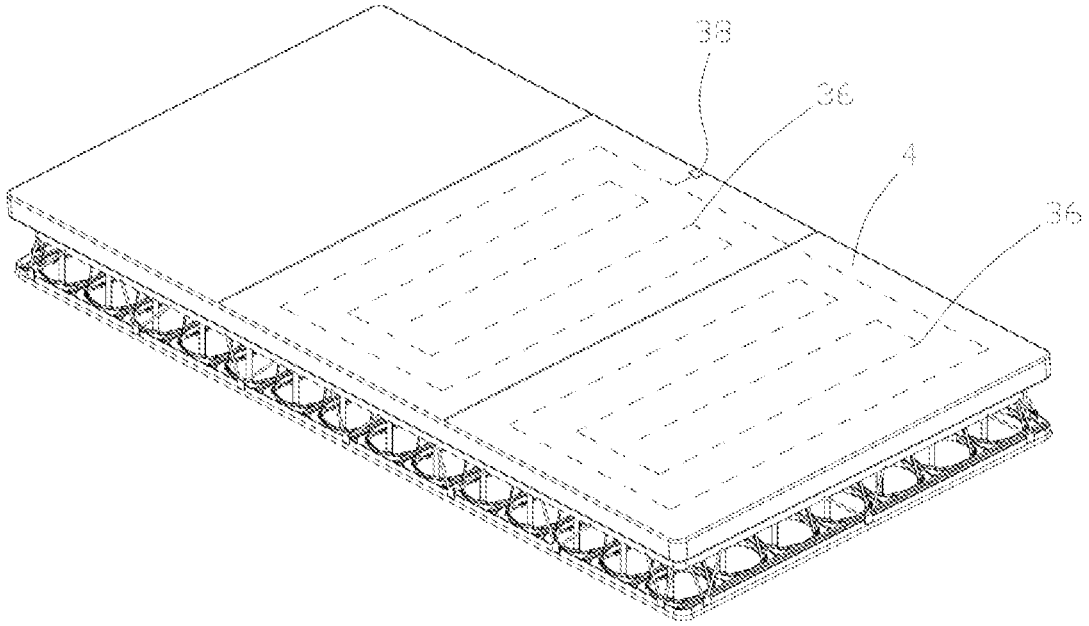
FIG. 42 is a schematic view of another structure wherein a pad layer of an elastic pad is provided therein with heating elements.

It is worth noting that any one of the elastic pads according to the present disclosure may not include heating elements 36. Alternatively, in some embodiments, referring to FIGS. 41 and 42, the pad layer 4 includes heating elements 36 configured to heat areas of the pad layer required to be heated. In the case, the current may be provided from a battery pack or mains circuit via a power interface 38 (e.g. a USB interface) of the heating elements 36, the heating elements 36 may heat the pad layer 4 to a set temperature, to improve the comfort of the elastic pad.

In some embodiments, the heating elements 36 may be arranged over the entire pad layer 4. Alternatively, in some embodiments, referring to FIG. 42, at least a part of multiple regions of the pad layer 4 are provided with respectively corresponding heating elements 36, and the heating elements 36 can be controlled so that the respective areas required to be heated can be heated by the respective corresponding heating elements 36 to meet the user's heating need in different areas. In addition, the plurality of heating elements 36 may be provided with one common power interface 38, or the plurality of heating elements 36 may be provided with respective corresponding power interfaces 38.

The elastic pad may be used as an outdoor pad or an elastic mattress.

Figure 25:
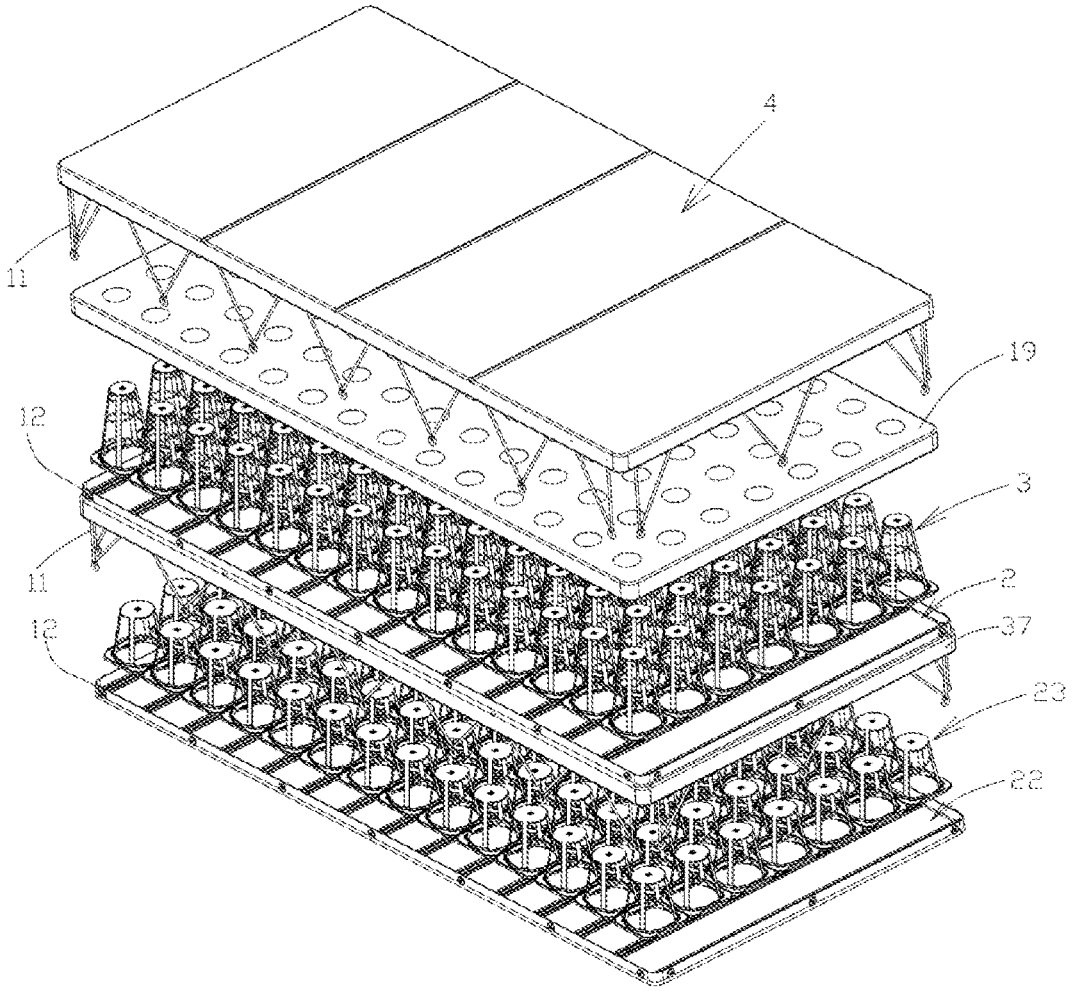
FIG. 25 is an exploded view of the elastic pad in FIG. 23.

In the second aspect, the present disclosure provides an elastic pad assembling method. Referring to FIGS. 5, 9, 22 and 25, the elastic pad assembling method comprises: providing an elastic support layer, the elastic support layer including at least one layer of elastic module mounting part, and a plurality of elastic modules disposed on the at least one layer of elastic module mounting part in a predetermined arrangement pattern manner in a height direction of the elastic pad. For example, FIG. 5 shows one layer of elastic module mounting part, such as a first elastic module mounting part 2, and FIG. 25 shows two layers of elastic module mounting parts, such as a first elastic module mounting part 2 and a second elastic module mounting part 22. Laying a pad layer on the plurality of elastic modules of a topmost layer in the height direction of the elastic pad; connecting an outer edge of the pad layer and an outer edge of the elastic module mounting part via a releasable connection structure, to assemble them into an elastic pad without an enclosing side surrounding cover.

In the elastic pad assembling method, since the outer edge of the pad layer and the outer edge of the elastic module mounting part are connected via a releasable connection structure, the elastic pad forms an elastic pad without an enclosing side surrounding cover, to thus avoid arranging an enclosing side surrounding cover in the surrounding area between the pad layer and the first elastic module mounting part. Therefore, the present disclosure can effectively reduce the number of components of the elastic pad, simplify the structure of the elastic pad, and lower the cost of the elastic pad. Since the first connection structure is releasable, the pad layer can be disassembled, which facilitates assembling and transportation of the elastic pad and reduces the storage space thereof. In addition, the elastic pad exhibits excellent performance in comfort In some embodiments, the elastic support layer includes a plurality of layers of elastic module mounting parts, for example, 2, 3, 4 or other number of layers. For instance, for the first elastic module mounting part 2 and the second elastic module mounting part 22 shown in FIG. 25, each layer of the elastic module mounting part is correspondingly provided thereon with a plurality of elastic modules, and the outer edge of the upper layer of elastic module mounting part and the outer edge of the lower layer of elastic module mounting part are connected via a releasable connection structure to assemble them into an elastic pad without an enclosing side surrounding cover. In this way, a multilayer elastic pad can be simply assembled and disassembled, and with a permeable inner structure and an excellent ventilation performance, thereby greatly improving comfort.

The releasable connection structure between the outer edge of the upper layer of elastic module mounting part and the outer edge of the lower layer of elastic module mounting part may be identical to or different from the releasable connection structure between the outer edge of the pad layer and the outer edge of the elastic module mounting part, which can be determined as acquired required.

In some embodiments, the outer edge of the pad layer 4 may be connected with an outer edge of any one layer of elastic module mounting part. Alternatively, in some embodiments, referring to FIGS. 5 and 25, the outer edge of the pad layer 4 and the outer edge of the topmost layer of the elastic module mounting part are connected via a releasable connection structure. Accordingly, the respective layer may be formed as independent connection layers such that connection stability of releasable connection structures of other layers is not affected when a releasable connection structure of one layer is accidentally released, thus further improving the reliability and comfort of the elastic pad.

The releasable connection structure may be of multiple types as long as an elastic pad without an enclosing side surrounding cover can be formed. For example, referring to FIGS. 5 and 25, the releasable connection structure includes connection ropes 11 and fixture buckles 12 that are releasably connected to each other, and when connected, the respective connection ropes 11 are buckled to the respective corresponding fixture buckles 12. In addition, the respective connection ropes 11 may be independent of one another, or may be connected with one another to form a wavy extending shape.

In some embodiments, the elastic module of each layer may have a small height. In some embodiments, the elastic module of each layer may have a greater height, to increase the desired height of the elastic pad.

In order to further improve the stability of the elastic pad, in some embodiments, laying, in the height direction of the elastic pad, a balance pad 19 on a predetermined layer of a plurality of elastic modules where the elastic modules reach a predetermined height, to limit transverse movement of the plurality of elastic modules of the predetermined layer. As all of the elastic modules (e.g. first elastic modules 3) are transversely limited by the balance pad 19, the respective elastic modules can be mutually restricted to improve the overall stability of all of the elastic modules.

In some embodiments, referring to FIG. 25, a height of the plurality of elastic modules of the topmost layer is greater than a height of a plurality of elastic modules of other layers (e.g. the height of the first elastic modules 3 is greater than the height of the second elastic modules 23), wherein laying the balance 19 on the plurality of elastic modules of the topmost layer in the height direction of the elastic pad to limit the transverse movement of the plurality of elastic modules of the top layer, and laying the pad layer 4 on the balance pad 19 in the height direction of the elastic pad. As all of the elastic modules are transversely limited by the balance pad 19, the respective elastic modules can be mutually restricted to improve the overall stability of all of the elastic modules.

In the third aspect, the present disclosure provides an elastic pad obtained through any one of the elastic pad assembly methods according to the second aspect. As described above, the elastic pad facilitates assembling and transportation and reduces the storage space thereof. The elastic pad also exhibits excellent performance in comfort. In addition, the elastic pad according to the present disclosure may be used as an outdoor pad, or may be used as an elastic mattress.

In the fourth aspect, the present disclosure provides a furniture comprising the elastic pad according to any one of the first and third aspects. As described above, with the elastic pad, the furniture exhibits excellent performance in stability and comfort while the furniture cost can be reduced, thus improving the overall quality.

The scope of protection of the present disclosure is defined only by the appended claims. Given the teaching of the present disclosure, those skilled in the art could easily envision using alternative structures of those disclosed herein as feasible alternative embodiments, and combining the embodiments disclosed herein to form new embodiments, which should all fall into the scope defined by the appended claims.

I claim:

1. An elastic pad, comprising:

a first elastic module mounting part including a first base layer having a first base layer upper surface and a first base layer lower surface, wherein an outer edge of the first base layer upper surface has first stop edges extending to a predetermined height;

a plurality of first elastic modules disposed on the first base layer upper surface between the first stop edges in a predetermined pattern; and a pad layer laid on the plurality of first elastic modules;

wherein an outer edge of the pad layer and the first stop edges are connected via a releasable first connection structure, the elastic pad having no side surrounding cover;

wherein the first base layer upper surface has a plurality of first positioning rails arranged at intervals in a lengthwise direction of the elastic pad, each of the first positioning rails extending along a width direction of the elastic pad, and first elastic module mounting areas respectively formed between adjacent first positioning rails, wherein in the width direction of the elastic pad, each of the first elastic modules is configured to form a sliding fit with an adjacent first positioning rail at either end of the adjacent first positioning rail to slide into the first elastic module mounting area, and further slide along the first positioning rail to a set position, so that each of the first elastic module mounting areas is provided with a plurality of the first elastic modules;

wherein the plurality of the first positioning rails are located between the first stop edges, and the first stop edges are configured to stop movement of the first elastic modules in the width direction of the elastic pad.

2. The elastic pad of claim 1, wherein the pad layer comprises a first stop ring extending from a lower surface of the pad layer towards the plurality of the first elastic modules, the first stop ring configured to enclose a first elastic module at an outermost side of the elastic pad, wherein the first stop ring is connected to the outer edge of the first elastic module mounting part via the first connection structure.

3. The elastic pad of claim 1, wherein the pad layer comprises a plurality of elastic blocks arranged in a lengthwise direction of the elastic pad, and adjacent elastic blocks are connected via a thinned flexible hinge part, so that the pad layer is foldable or rollable.

4. The elastic pad of claim 1, wherein the elastic modules are arranged in rows and columns, and the pad layer is spaced apart from the elastic module mounting part by the elastic modules providing open-ended channels between them, the open-ended channels extending in between and through the rows and columns of elastic modules.

5. The elastic pad of claim 4, wherein a plurality of connection ropes are arranged at intervals on one of the outer edge of the pad layer and the outer edge of the elastic module mounting part, and a plurality of fixture buckles are arranged at intervals on the other one of the outer edge of the pad layer and the outer edge of the elastic module mounting part, wherein each of the connection ropes is attachable around one of the fixture buckles.

6. The elastic pad of claim 5, wherein a first plurality of the fixture buckles are disposed at predetermined intervals on the outer edge of the pad layer, a second plurality of the fixture buckles are disposed at predetermined intervals on the outer edge of the first elastic module mounting part, and the connection ropes connect the first plurality of the fixture buckles of the pad layer and the second plurality of the fixture buckles of the first elastic module mounting part in a wavy extension path.

7. The elastic pad of claim 6, wherein the first plurality of the fixture buckles and the second plurality of fixture buckles are arranged successively and alternately at intervals, wherein the first plurality of the fixture buckles are hanging holes, and the second plurality of the fixture buckles are hooks.

8. The elastic pad of claim 1 further including a balance pad on top of the plurality of the first elastic modules to limit transverse movement of the plurality of the first elastic modules, and the pad layer is on top of the balance pad.

9. The elastic pad of claim 1, wherein the elastic pad further comprises:

a second elastic module mounting part; and a plurality of second elastic modules disposed on top of the second elastic module mounting part in a predetermined pattern;

wherein the first elastic module mounting part is on top of the plurality of the second elastic modules, and an outer edge of the second elastic module mounting part is connected to the outer edge of the first elastic module mounting part via a releasable second connection structure.

10. The elastic pad of claim 9, wherein a height of the first elastic module is greater than a height of the second elastic module, wherein the elastic pad comprises a balance pad laid on the plurality of the first elastic modules to limit transverse movement of the plurality of the first elastic modules, and the pad layer is laid on the balance pad.

11. The elastic pad of claim 1, wherein the plurality of the first elastic modules are divided into a first module group and a second module group arranged in a lengthwise direction of the elastic pad, wherein a height of a plurality of first elastic modules in the first module group is greater than a height of a plurality of first elastic modules in the second module group, and the pad layer is laid on the first module group and the second module group so that a first pad layer area corresponding to the first module group and a second pad layer area corresponding to the second module group are formed on the pad layer due to a height difference between the first module group and the second module group, wherein the first pad layer area is higher than the second pad layer area, and an area of the first pad layer area is smaller than an area of the second pad layer area.

12. The elastic pad of claim 1, wherein at least a part of a plurality of regions of the pad layer are provided with individually controllable heating elements.

13. An elastic pad assembling method, comprising:

providing an elastic support layer comprising at least one layer of an elastic module mounting part and a plurality of elastic modules, wherein the at least one layer of elastic module mounting part includes a base layer having a base layer upper surface and a base layer lower surface, wherein an outer edge of the base layer upper surface has stop edges extending to a predetermined height, and the plurality of elastic modules are disposed on the base layer upper surface between the stop edges in a predetermined pattern;

laying a pad layer on the plurality of the elastic modules of a topmost layer in the height direction of the elastic pad; and connecting an outer edge of the pad layer to the stop edges via a releasable connection structure to form an elastic pad without an enclosing side surrounding cover;

wherein the base layer upper surface has a plurality of positioning rails arranged at intervals in a lengthwise direction of the elastic pad, each of the positioning rails extending in a width direction of the elastic pad, and elastic module mounting areas respectively formed between adjacent positioning rails, wherein in the width direction of the elastic pad, each of the elastic modules is configured to form a sliding fit with an adjacent positioning rail at either end of the adjacent positioning rail to slide into the elastic module mounting area, and further slide along the positioning rail to a set position, so that each of the elastic module mounting areas is provided with a plurality of the elastic modules;

wherein the plurality of the positioning rails are located between the stop edges and the stop edges are configured to stop movement of the elastic modules in the width direction of the elastic pad.

14. The elastic pad assembling method of claim 13, wherein the elastic support layer comprises a plurality of layers of elastic module mounting parts, each layer of the elastic module mounting part is provided with a plurality of corresponding elastic modules, and an outer edge of a topmost layer of elastic module mounting part is connected with an outer edge of a lowermost layer of elastic module mounting part via a releasable connection structure so as to form an elastic pad without an enclosing side surrounding cover.

15. The elastic pad assembling method of claim 14, further comprising: connecting the outer edge of the pad layer with the outer edge of the topmost layer of elastic module mounting part via a releasable connection structure.

16. The elastic pad assembling method of claim 13, wherein the releasable connection structure comprises connection ropes and fixture buckles that are releasably connected to each other, further comprising attaching each connection rope to a corresponding fixture buckle.

17. The elastic pad assembling method of claim 13 further comprising: laying, in the height direction of the elastic pad, a balance pad on a predetermined layer of a plurality of elastic modules where the elastic modules reach a predetermined height, to limit transverse movement of the plurality of the elastic modules of the predetermined layer.

18. An elastic pad, wherein the elastic pad assembled through the elastic pad assembling method of claim 13.

19. Furniture comprising the elastic pad of claim 1.

20. The elastic pad of claim 1, wherein the releasable connection structure extends longitudinally along the sides of the pad layer and the mounting part.

21. The elastic pad of claim 20, wherein the releasable connection structure is positioned entirely around a perimeter of the pad layer and the mounting part.

22. The elastic pad of claim 21, wherein the releasable connection structure is oriented in a plane perpendicular to the pad layer.

23. The elastic pad of claim 1, wherein the releasable connection structure comprises a cord extending through a fixture on at least one of the mounting part and the pad layer.

24. The elastic pad of claim 1, wherein the releasable connection structure comprises a cord extending through holes in at least one of the mounting part and the pad layer.

25. The elastic pad of claim 23 wherein only the cord is positioned between the mounting part and the pad layer at the sides of the elastic pad.

26. The elastic pad of claim 1, wherein the elastic modules are arranged in a pattern or columns and rows with unobstructed continuous open-ended channels extending in between and through the rows and columns of elastic modules.

27. The elastic pad of claim 1 wherein connection structure is directly attached to the pad layer.

* * * * *